US006858789B2

(12) United States Patent
Muramatsu et al.

(10) Patent No.: US 6,858,789 B2
(45) Date of Patent: Feb. 22, 2005

(54) MUSICAL INSTRUMENT EQUIPPED WITH AUTOMATIC PLAYER FOR PERFORMING MUSIC WITHOUT HARSH TONE

(75) Inventors: Shigeru Muramatsu, Shizuoka (JP); Tatsuya Makino, Shizuoka (JP)

(73) Assignee: Yamaha Corporation (JP)

( * ) Notice: Subject to any disclaimer, the term of this patent is extended or adjusted under 35 U.S.C. 154(b) by 174 days.

(21) Appl. No.: 10/375,080

(22) Filed: Feb. 28, 2003

(65) Prior Publication Data

US 2003/0167905 A1 Sep. 11, 2003

(30) Foreign Application Priority Data

Mar. 5, 2002 (JP) ..... 2002-058494

(51) Int. Cl.[7] ..... G10H 7/00

(52) U.S. Cl. ..... 84/600; 84/94.1; 84/94.2; 84/95.2

(58) Field of Search ..... 84/600, 609–610, 84/649–650, 2, 94.1–94.2, 95.1–95.2, 363, 402, 477 R

(56) References Cited

U.S. PATENT DOCUMENTS

| | | | | | |
|---|---|---|---|---|---|
| 4,090,349 | A | * | 5/1978 | Takase | 368/156 |
| 4,466,328 | A | | 8/1984 | Kitamura | |
| 4,545,282 | A | * | 10/1985 | Arnett et al. | 84/317 |
| 4,890,528 | A | * | 1/1990 | Kamijima | 84/95.2 |
| 5,703,305 | A | * | 12/1997 | Isaka | 84/95.1 |
| 5,962,796 | A | | 10/1999 | Nakamura | |
| 6,323,404 | B1 | * | 11/2001 | Hayashi | 84/94.1 |
| 6,723,911 | B2 | * | 4/2004 | Muramatsu et al. | 84/723 |
| 6,762,352 | B2 | * | 7/2004 | Liu | 84/94.1 |

* cited by examiner

*Primary Examiner*—Marlon T. Fletcher
(74) *Attorney, Agent, or Firm*—Dickstein, Shapiro, Morin & Oshinsky, LLP.

(57) ABSTRACT

A music box includes daisy reed wheels, the reeds of which are respectively associated with player's fingers, and the player's fingers are selectively energized for plucking the reeds for generating tones; the reeds of the daisy reed wheels form reed groups respectively assigned to tones, and a controller selects reeds from the reed groups in such a manner that any one of the reeds of each group is not plucked with the player's finger, whereby the controller prevents the vibrating reeds from the plucking.

20 Claims, 19 Drawing Sheets

| NOTE NO. Kn | COUNT CNT | PLAYER'S FINGER SOL(n) |
|---|---|---|
| 48 | 0 | SOLA(K48) |
| 48 | 1 | SOLB(K48) |
| 48 | 2 | SOLC(K48) |
| 48 | 3 | SOLD(K48) |
| 49 | 0 | SOLA(K49) |
| 49 | 1 | SOLB(K49) |
| 49 | 2 | SOLC(K49) |
| 49 | 3 | SOLD(K49) |
| 50 | 0 | SOLA(K50) |
| 50 | 1 | SOLB(K50) |
| ⋮ | ⋮ | ⋮ |
| 71 | 0 | SOLA(K71) |
| 71 | 1 | SOLB(K71) |
| 71 | 2 | SOLC(K71) |
| 71 | 3 | SOLD(K71) |

Fig. 8

| CNT(Kn) | CNT |
|---|---|
| CNT(K48) | 0(0~3) |
| CNT(K49) | 1 |
| ⋮ | ⋮ |
| CNT(K71) | 0 |

| TCNT(Kn) I.V. =501) | TCNT VALUE |
|---|---|
| TCNT(K48) | 12 |
| TCNT(K49) | 1 |
| TCNT(K50) | 352 |
| ⋮ | ⋮ |
| TCNT(K71) | 682 |

Fig. 13

| NOTE NO. Kn | COUNT CNT | PLAYER'S FINGER SOL(n) |
|---|---|---|
| 48 | 0 | SOLA(K48)+SOLC(K48) |
| 48 | 1 | SOLB(K48) |
| 48 | 2 | SOLA(K48)+SOLC(K48) |
| 48 | 3 | SOLD(K48) |
| 49 | 0 | SOLA(K49)+SOLC(K49) |
| 49 | 1 | SOLB(K49) |
| 49 | 2 | SOLA(K49)+SOLC(K49) |
| 49 | 3 | SOLD(K49) |
| 50 | 0 | SOLA(K50)+SOLC(K50) |
| 50 | 1 | SOLB(K50) |
| ⋮ | ⋮ | ⋮ |
| 71 | 0 | SOLA(K71)+SOLC(K71) |
| 71 | 1 | SOLB(K71) |
| 71 | 2 | SOLA(K71)+SOLC(K71) |
| 71 | 3 | SOLD(K71) |

Fig. 16

MUSICAL INSTRUMENT EQUIPPED WITH AUTOMATIC PLAYER FOR PERFORMING MUSIC WITHOUT HARSH TONE

FIELD OF THE INVENTION

This invention relates to a musical instrument and, more particularly, to a musical instrument equipped with an automatic player such as, for example, a music box.

DESCRIPTION OF THE RELATED ART

A typical example of the music box comprises an array of reeds and a barrel drum. Small projections are formed on the outer surface of the barrel drum, and the barrel drum is driven for rotation. While the barrel drum is rotating, the small projections are selectively brought into contact with the reeds, and pluck them for generating tones through the vibrations of the reeds.

Another music box includes solenoid-operated actuators instead of the barrel drum. The solenoid-operated actuators are selectively energized so that the plungers project from the yokes. The plungers pluck the reeds for generating the vibrations. Such a music box equipped with solenoid-operated actuators is hereinbelow referred to as "electric music box".

The first electric music box is also broken down into the tone generator, which is implemented by an array of reeds, and an automatic player. The reeds are arranged in a single row on a virtual straight line. The automatic player includes a rotational cylinder, pins, solenoid-operated actuators and a controlling circuit. The rotational cylinder has an axis of rotation, which is in parallel to the array of reeds. Through-holes are formed in the cylinder, and the pins are received in the through-holes. The pins are projectable from and retractable into the through-holes. The solenoid-operated actuators are accommodated in the cylinder, and push and pull the associated pins. The controlling circuit is electrically connected to the solenoid-operated actuators, and selectively supplies driving current to the solenoid-operated actuators. The reeds are respectively aligned with the orbits of the pins. While the solenoid-operated actuators are keeping the pins retracted into the through-holes, the reeds are spaced from the outer surface of the cylinder, and any reed is not plucked. When the controlling circuit energizes a solenoid-operated actuator, the solenoid-operated actuator makes the associated pin project from the through-hole, and the pin plucks the associated reed.

The second prior art music boxes includes the tone generator, which is also implemented by an array of reeds, and an automatic player with a complex mechanism. The reeds are arranged in a row on a virtual straight line. The automatic player includes a turn-table, plural solenoid-operated actuators, hammers and a controlling circuit. The hammers are provided in association with the reeds for striking the associated reeds, and are rotatably supported by a frame.

The turn-table has an axis of rotation vertical to the array of reeds so that the rotating surface of the turn-table is maintained in parallel to the array of reeds. The solenoid-operated actuators are fixed to the turn-table, and the controlling circuit selectively supplies driving current to the solenoid-operated actuators. The solenoid-operated actuators keep the plungers retracted into the associated solenoids in the absence of the driving current. Even though the turn-table is rotated, the plungers do not kick the hammers, and, accordingly, the hammers never strike the reeds.

When the user requests the automatic player to perform a piece of music, the turn-table is driven for rotation, and the controlling circuit starts to selectively supply the driving current to the solenoid-operated actuators. The solenoid-operated actuators project the plungers in the presence of the driving current, and the plungers kick the associated hammers. Then, the hammers strike the associated reeds, and give rise to vibrations of the reeds. The reeds generate the tones for performing the piece of music.

The problem inherent in the prior art electric music boxes is unstable tones in repetition. In performance, the automatic player sometimes repeats the striking or plucking on a certain reed. If the automatic player gives the second shot to the reed, which is still vibrating, the vibrating reed tends to generate noise or make the tone harsh due to chattering.

In order to remove the vibrations from the reeds, the third electric music box is equipped with a damper. The damper is provided in the proximity of the reeds, and is pressed to the vibrating reeds after the generation of the tones. The damper surely prevents the third electric music box from the noise or harsh tones. However, the damper is pressed to all the reeds. Even if the reverberations are required for certain tones in the passage, the damper concurrently extinguishes all the tones before the next plucking so that the passage is monotony.

SUMMARY OF THE INVENTION

It is therefore an important object of the present invention to provide a musical instrument, an automatic player of which performs a passage on vibratory members without harsh tones.

It is also an important object of the present invention to provide a musical instrument, an automatic player of which gives artistic presentation to a passage.

To accomplish the objects, the present invention proposes to assign plural vibratory members to each tone for selectively driving the vibratory members for vibrations.

In accordance with one aspect of the present invention, there is provided a musical instrument for generating acoustic tones comprising a tone generator including plural tone generating units each having plural vibratory members for generating the acoustic tones through vibrations, the vibratory members of the plural tone generating units forming plural vibratory groups respectively assigned to the acoustic tones and an automatic player including plural sets of player's fingers respectively associated with the plural tone generating units and selectively actuated so as to give rise to the vibrations in the associated vibratory members and a controller connected to the player's fingers and selectively actuating the player's fingers on the basis of pieces of music data for generating the tones along a passage, and the controller has a monitor producing a report indicative of the vibratory members already driven for vibrations for generating tones along the passage, a selector checking the report for the vibratory members already driven for the vibrations and selecting other vibratory members from the vibratory groups respectively containing the vibratory members already driven for the vibrations so as to prevent the vibratory members already driven for the vibrations from being continuously driven for vibrations before a decay of the vibrations and a driver selectively actuating the player's finger associated with the other vibratory members and the vibratory members not driven for vibrations for generating the tones along the passage.

BRIEF DESCRIPTION OF THE DRAWINGS

The features and advantages of the musical instrument will be more clearly understood from the following description taken in conjunction with the accompanying drawings, in which FIG. 1. is a plane view showing a tone generating unit incorporated in a musical instrument according to the present invention, FIG. 8 is a view showing contents of an actuator table stored in a read only memory, FIG. 13 is a view showing timer counters established in a random access memory of another musical instrument according to the present invention, FIG. 16 is a view showing an actuator table for yet another musical instrument according to the present invention.

DESCRIPTION OF THE PREFERRED EMBODIMENTS

First Embodiment

Structure of Musical Instrument

Figure 1:
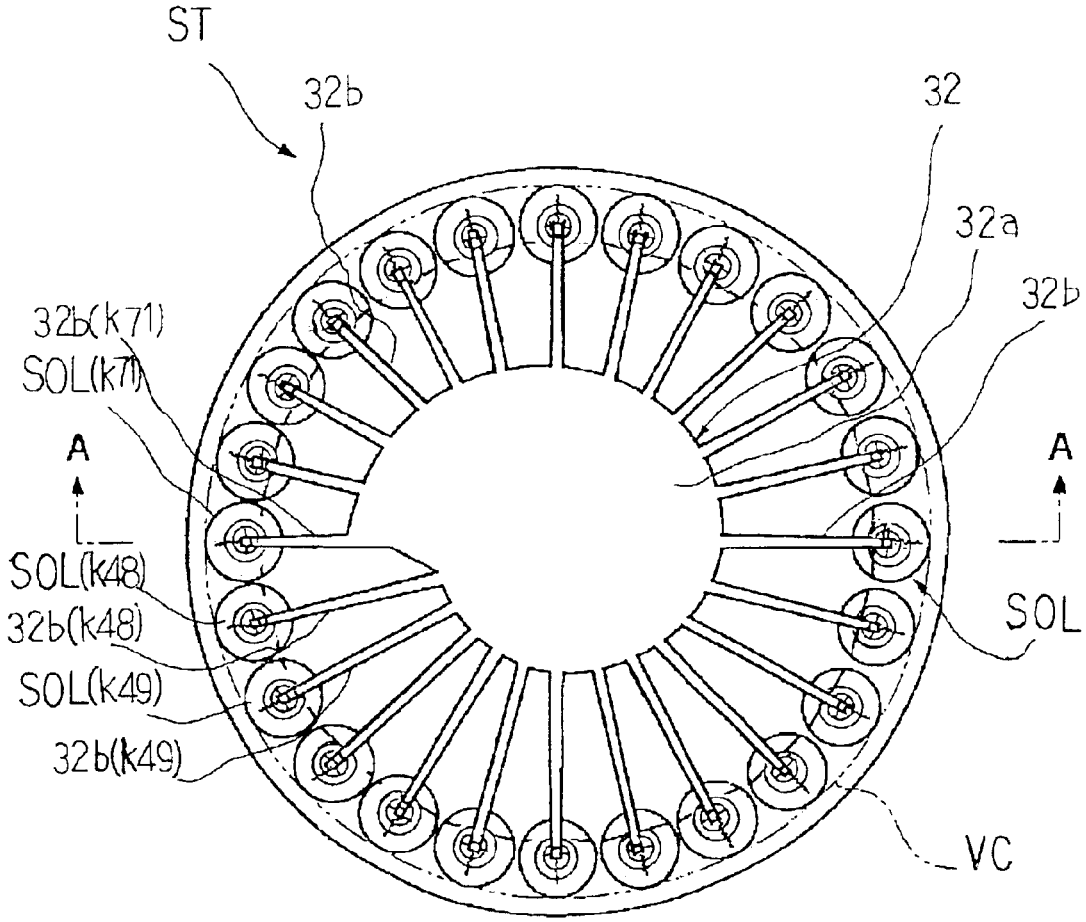
Figure 2:
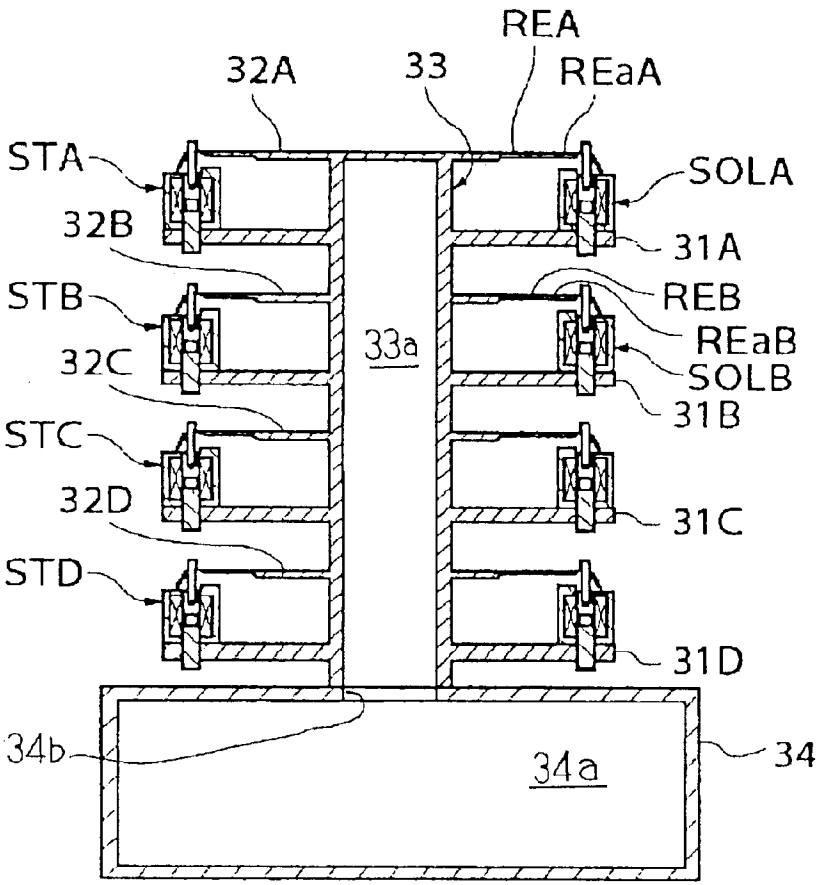
FIG. 2 is a cross sectional view taken along line A—A of FIG. 1 and showing the structure of the musical instrument.

Referring to FIGS. 1 and 2 of the drawings, a musical instrument embodying the present invention comprises plural tone generating stages STA/STB/STC/STD, a post 33, a resonator box 34 and a controller CL. The musical instrument is categorized in the music box. The post 33 defines an inner space 33*a*, and is formed with disk-shaped trays 31A/31B/31C/31D. The disk-shaped trays 31A/31B/31C/31D are spaced from one another in the direction of the centerline of the post 33, and are respectively assigned to the tone generating stages STA/STB/STC/STD. The controller CL is connected in parallel to the tone generating stages STA/STB/STC/STD, and selectively activates the tone generating stages STA/STB/STC/STD for generating tones. The resonator box 34 is formed with a resonating chamber 34*a*, and the resonating chamber 34*a* is connected to the outside thereof through a sound hole 34*b*. The inner space 33*a* is aligned with the sound hole 34*b*, and the post 33 is secured to the resonator box 34. For this reason, when the tone generating stages STA/STB/STC/STD are generating vibrations for tones, the vibrations are propagated through the post 33 to the resonator box 34, and the loud tones are radiated from the musical instrument by means of the resonating chamber 34*b*.

The tone generating stages STA/STB/STC/STD are similar in structure to one another, and reference ST is hereinafter representative of any one of the tone generating stages STA/STB/STC/STD. The tone generating stage ST includes a daisy reed wheel 32 and a set of player's fingers SOL. "A", "B", "C" and "D" are added to the references 32 and SOL depending upon the tone generating stages STA/STB/STC/STD. The daisy reed wheel 32 and set of player's fingers SOL incorporated in the tone generating stage STA are, by way of example, labeled with references 32A and SOLA, respectively.

Figure 3:
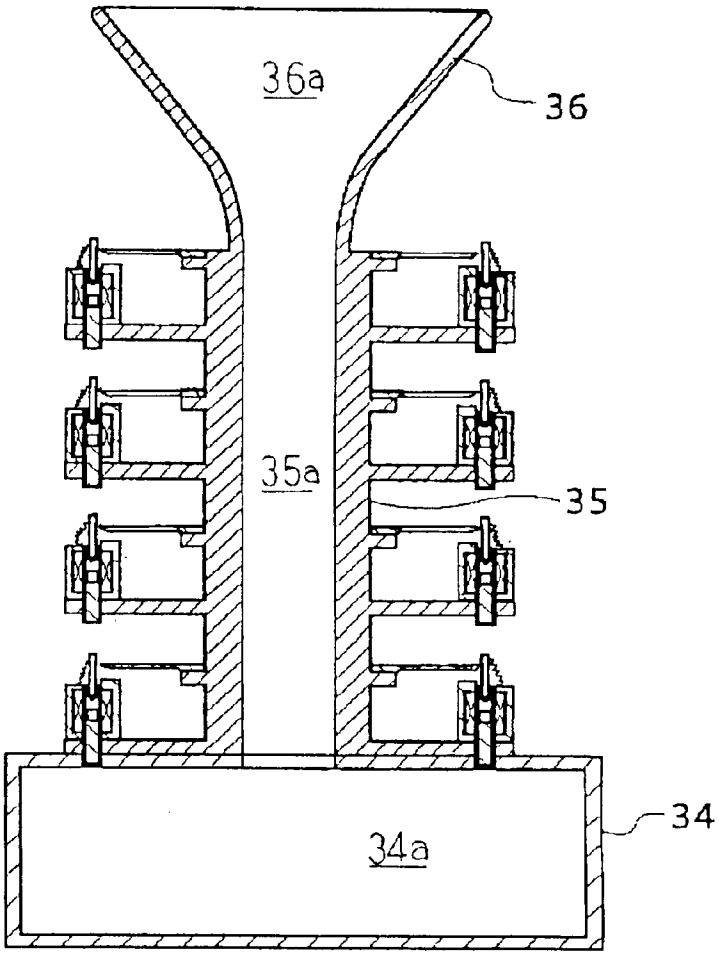
FIG. 3 is a cross sectional view showing the structure of a modification of the musical instrument.

The post 33 may be replaced with a cylinder 35 and a bell 36 as shown in FIG. 3. A cylindrical space 35*a* is constant in cross section, and the horn space 36*a* is gradually increased in cross section toward the open end. The resonating chamber 34*a* is connected through the cylindrical space 35*a* to the horn space 36*a* so that the loud tones are radiated through the cylinder 35 and bell 36 to the air at high efficiency.

Turning back to FIG. 1, the daisy reed wheel 32 has a hub 32*a* and reeds 32*b*. The hub 32*a* has the radius varied together with the angle so that the distance from the center and the periphery is varied. The reeds 32*b* have the length and width varied in such a manner as to have tips arranged on a virtual circle VC. The reeds 32*b* radially project from the hub 32*a*, and are designed to generate tones of the scale. In this instance, twenty-four reeds 32*b* are incorporated in the daisy reed wheel 32. In the following description, term "inward" is indicative of a position closer to the center of the hub 32*a* than an "outward" point.

In the first embodiment, the daisy reed wheels 32A/32B/32C/32D, post 33 and resonator box 34 as a whole constitute a tone generator, and the player's fingers SOLA/SOLB/SOLC/SOLD and a controller, which will be described hereinafter in detail, form in combination an automatic player.

The player's fingers SOL of the set associated with the daisy reed wheel 32 are arranged around the daisy reed wheel 32, and are respectively associated with the reeds 32*b*. The controller CL is connected to the player's fingers SOL in parallel, and selectively activates the player's fingers SOL for plucking the associated reeds 32*b*. When the player's fingers SOL give rise to vibrations in the reeds 32*b* through the plucking, the vibrating reeds 32*b* generate the tones. The pitch of the tones generated from the daisy reed wheel 32 is indicated by k48, k49, . . . and k71. The number is increased in the counter clockwise direction. Accordingly, the reeds 32*b* for generating.the tones k48-k71 are designated by references 32*b* (k48), 32*b*(k49), . . . and 32*b*(k71), and the player's fingers SOL associated with the reeds 32*b*(k48) to 32*b*(k71) are designated by references SOL(k48), SOL (k49), . . . and SOL(k71), respectively.

The daisy reed wheels 32B/32C/32D and other sets of player's fingers SOLB/SOLC/SOLD are same as the daisy reed wheel 32A and set of player's fingers SOLA. For this reason, no further description is made on the other daisy reed wheels 32B/32C/32D and other sets of player's fingers SOLB/SOLC/SOLD for the sake of simplicity. A tone is assigned to the reeds 32*b* of the daisy reed wheels 32A/32B/32C/32D. For example, the tone k48 is generated from the reeds 32*b* (k48) of the daisy reed wheels 32A/32B/32C/32D. The reeds, which are assigned a certain tone, form a group of reeds or a reed group. Thus, twenty-four groups of reeds are incorporated in the four tone generating stages STA/STB/STC/STD.

Figure 4A:
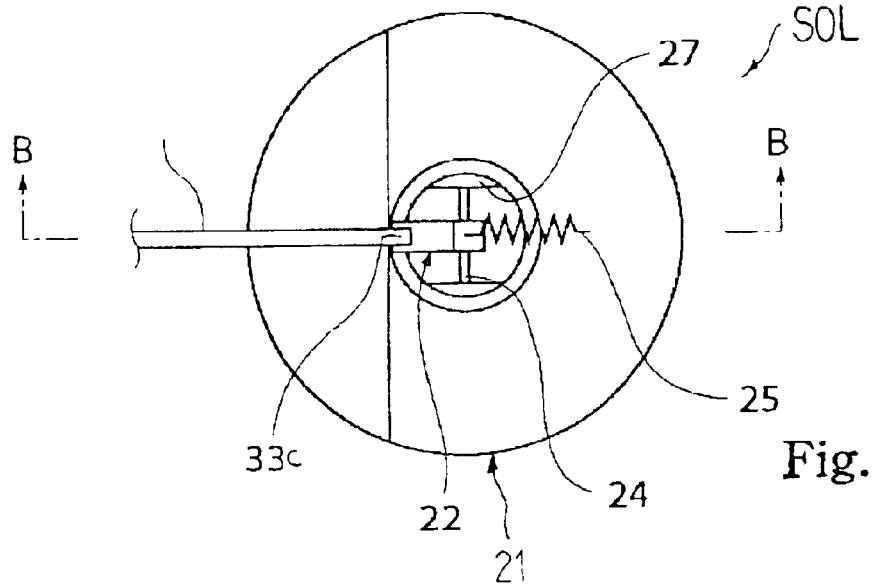
FIG. 4A is a plane view showing a player's finger used in the musical instrument.
Figure 4B:
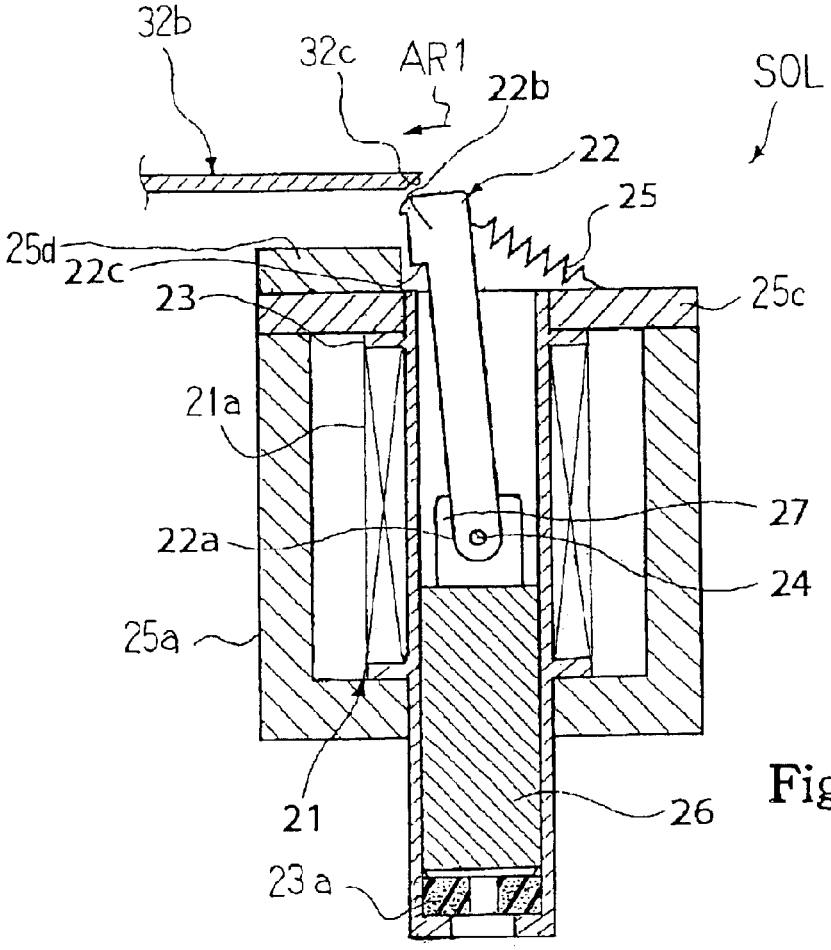
FIG. 4B is a cross sectional view taken along line B—B of FIG. 4A and showing the structure of the player's finger.

All of the player's fingers SOLA/SOLB/SOLC/SOLD have the following structure. FIGS. 4A and 4B show one of the player's fingers SOL. The player's finger SOL is broken down into a solenoid-operated actuator 21, a pick 22 and a spring 25. The solenoid-operated actuator 21 is supported by a casing 25*a*, which in turn is supported by the associated disk-shaped tray 31A/31B/31C/31D, and the pick 22 is mounted on the solenoid-operated actuator 21. The spring 25 is connected between the pick 22 and the casing 25*a*, and urges the pick 22 outwardly.

A coil 21*a*, a bobbin 23, a cushion sheet 23*a*, a bottom yoke 25*a*, a top yoke 25*c*, an additional yoke 25*d* and a plunger 26 form in combination the solenoid-operated actuator 21. The bobbin 23 has a cylindrical configuration, and the cushion sheet 23*a* is provided at the bottom of the inner space of the bobbin 23. The coil 21 is wound on the outer surface of the bobbin 23, and the plunger 26 is slidably received in the inner space of the bobbin 23. The additional yoke 25*d* projects from an inward top portion of the top yoke 25*c*, and forms an offset yoke structure together with the bottom yoke 25*a*. When current flows through the coil 21*a*, the current creates a magnetic field, and the bobbin 23 and offset yoke structure 25*a*/25*c*/245*d* offer a magnetic path to the electric field. The inward portion of the offset yoke structure is taller than the outer portion of the top yoke 25*c* so that the magnetic field is asymmetrically developed. The picks 22 are inwardly urged as indicated by arrow AR1 in the magnetic field, and the plunger 26 upwardly projects from the bobbin 23 in the magnetic field. The inwardly inclined pick 22 is brought into contact with the tip 32*c* of the associated reed 32*b*. If the magnetic field is removed, then the plunger 26 is retracted into the bobbin 23, and is landed on the cushion sheet 23*a*. The cushion sheet 23*a* prevents the plunger 26 from dropping out and undesirable noise.

The plunger 26 is formed with a pair of wall portions 27. The wall portions 27 are upright on the upper surface of the plunger 26, and are spaced from each other in parallel to the associated reed 32*b*. A pin 24 is fixed at both ends thereof to the wall portions 27 in such a manner as to be perpendicular to the longitudinal direction of the associated reed 32*b*, and the pick 22 is rotatably connected at the lower portion 22*a* thereof to the pin 24. The pick 22 is a thin narrow plate of soft magnetic material, and is rotatable about the pin 24. The extension line of the centerline of the associated reed 32*b* is on the trajectory of the pick 22.

The pick 22 has an upper end portion 22*b*, which is wider than the lower end portion 22*a* so that a step 22*c* is formed at the boundary between the upper end portion 22*b* and the lower end portion 22*a*. The upper end portion 22*b* is formed with a rounded end surface. On the other hand, the tip 32*c* of the reed 32*b* is tapered. While the plunger 26 is projecting from the bobbin 23, the rounded end surface is brought into contact with the tapered tip 32*c*, and makes the reed 32*b* warped.

The spring 25 is connected at one end thereof to the upper portion 22*b* of the pick 22 and at the other end thereof to the top yoke 25*c*. While the plunger 26 is resting in the bobbin 23, the spring 25 is almost in its free length, and a negligible amount of elastic force is exerted on the pick 22. The spring 25 increases the elastic force together with the distance between the pick 22 and the top yoke 25*c*, and urges the pick 22 outwardly.

As described hereinbefore, when the current starts to flow through the coil 21*a*, the magnetic force makes the pick 22 inwardly inclined. The magnetic force is larger than the elastic force of the spring 25 in the initial stage where the pick 22 warps the reed 32*b*. When the step 22*c* exceeds the upper end of the additional yoke 25*d*, the space between the pick 22 and the top yoke 25*a* is so wide that the magnetic force is equalized to the elastic force. The plunger 26 further projects upwardly, and the step 22*c* is spaced from the additional yoke 25*d*. Then, the elastic force becomes larger than the magnetic force, and the pick 22 escapes from the reed 32*b*. Then, the reed 32*b* vibrates for generating the tone. While the plunger 26 is being retracted into the bobbin 23, the spring 25 keeps the pick 22 inclined outwardly. Thus, the spring 25 prevents the pick 22 from chattering.

Figure 5A:
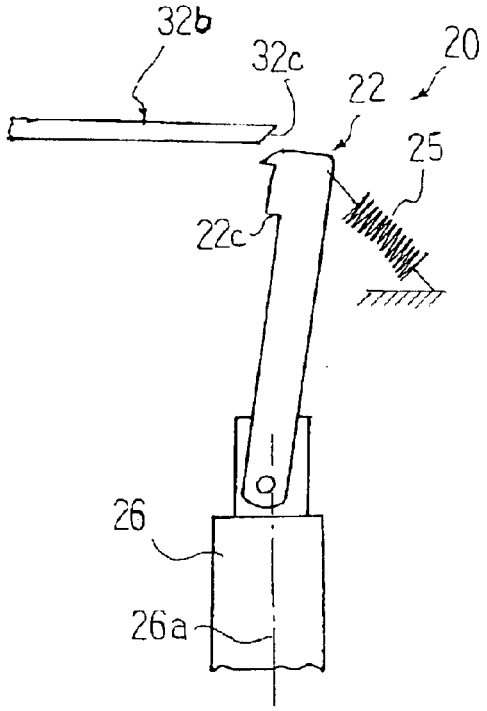
FIGS. 5A to 5C are schematic views showing the player's finger plucking an associated reed.

The player's finger SOL behaves for plucking the associated reed 33*b* as follows. The controller CL is assumed to have already removed the magnetic field from the player's finger SOL. The pick 22 is outwardly inclined with respect to the centerline 26*a* of the plunger 26, and the rounded end surface of the upper end portion 22*b* is spaced from the tapered tip 32*c* as shown in figure 5A.

Figure 5B:
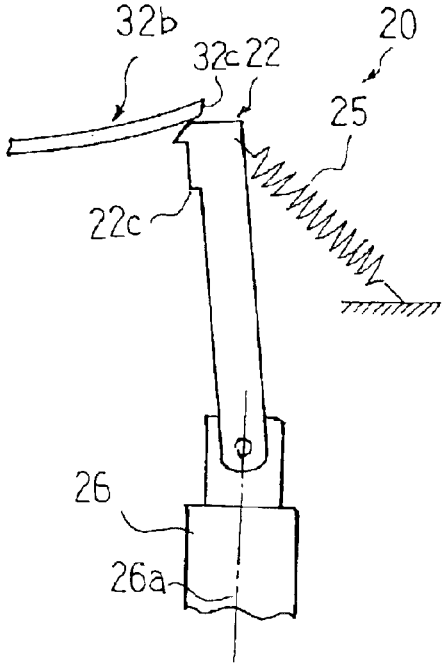

When the current flows through the coil 21*a*, the pick 22 is inwardly inclined, and the plunger 26 starts to upwardly project against the elastic force of the spring 25. The plunger 26 is brought into contact with the tapered tip 32*c*, and pushes the reed 32*b* upwardly. Although the expanded spring 25 increases the elastic force exerted on the pick 22, the magnetic force is still larger than the elastic force so that the pick 22 makes the reed 32*b* warped as shown in FIG. 5B.

The plunger 26 further projects form the bobbin 23, and the pick 22 becomes far from the coil 21*a*. When the magnetic force becomes smaller than the elastic force, the spring 25 pulls the pick 22 outwardly, and the pick 22 escapes from the reed 32*b*. Then, the reed 32*b* starts the vibrations, and generates the tone. When the plunger 26 reaches the upper dead point, the magnetic field is removed from the solenoid-operated actuator 21, and the plunger 26 starts to return to the rest position. While the plunger is being retracted into the bobbin 23, the spring 25 keeps the pick 22 outwardly inclined. For this reason, the pick 22 does not interfere with the vibrating reed 32*b*.

The other player's fingers SOL behave along the above-described sequence so as to pluck the associated reeds 32*b*.

System Configuration of Controller

Figure 6:
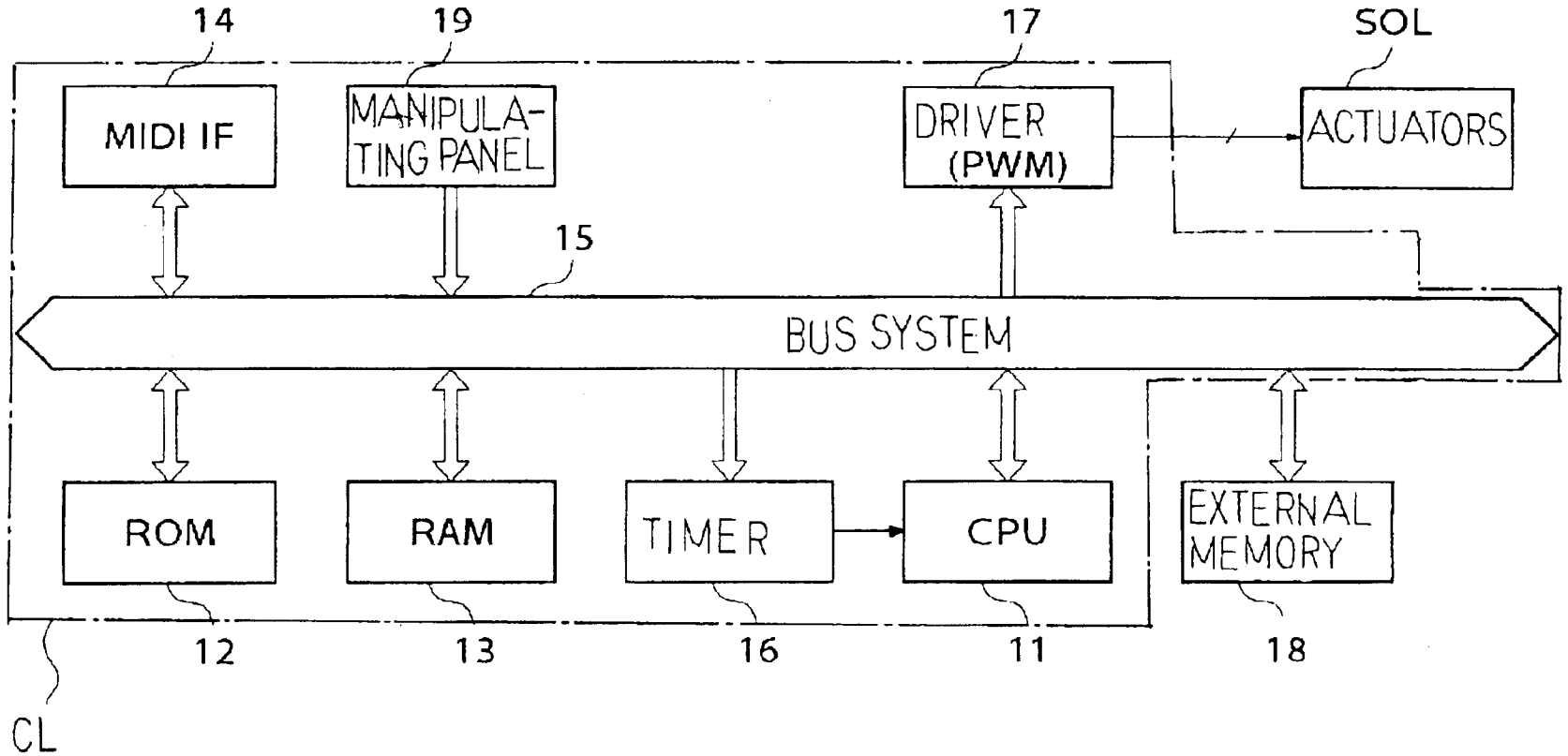
FIG. 6 is a block diagram showing the system configuration of a controller incorporated in the musical instrument.

FIG. 6 shows the system configuration of the controller CL. The controller CL includes a central processing unit, which is abbreviated as "CPU" 11, a read only memory 12, i.e., ROM, a random access memory 13, i.e., RAM, a MIDI (Musical Instrument Digital Interface) 14, a timer 16, a driver 17 and a manipulating panel 19. These system components 11/12/13/14/16/17/19 are connected to a bus system 15 so that the central processing unit 11 fetches instruction/data codes from and transfers the data codes to the other system components 12/13/14/16/17/19. Though not shown in FIG. 6, a suitable interface is further incorporated in the controller CL, and an external memory device 18 is further connected to the bus system 15 through the interface. The driver circuit 17 includes a pulse width modulator PWM, and the pulse width modulator PWM selectively supplies a driving signal to the solenoid-operated actuators 21 after adjustment to an appropriate pulse width.

The pulse width modulator PWM incorporated in the driver circuit 17 controls the loudness of the tones to be produced through the vibrations of the reeds 32*b*. The central processing unit 11 is assumed to instruct the driver circuit 17 to supply the driving signal for generating a loud tone. The pulse width modulator PWM increases the pulse width of the driving signal, and supplies it to the solenoid-operated actuator associated with the reed 32*b* to be plucked. When the driving signal reaches the coil 21*a*, a large amount of current flows, and creates a strong magnetic field. The pick 22 is strongly attracted to the inner portion of the additional yoke 25*d*, and the plunger upwardly projects from the bobbin 23 powerfully. The magnetic force is so large that the spring can not outwardly incline the pick 22 as usual. Thus, the driving signal with the wide pulse width results in the strong attractive force exerted on the pick 22 as well as the speed-up of the plunger 26. For this reason, the pick 22 makes the reed 32*b* widely warped. The elastic force exceeds the magnetic force later than usual. Then, the pick 22 escapes from the tapered tip 32*c*, and permits the reed 32*b* to vibrate. The escape is later than the usual escape is. This means that the reed 32*b* is widely warped, and the amplitude of the vibrations is wider than the amplitude of the usual vibrations. This results in the loud tone.

A user gives instructions for task and/or options to the central processing unit 11 through the manipulating panel 19. The user manipulates specifies a piece of music through switches assigned to the selection of music, makes the musical instrument start and stop the performance through a start button and a stop button, and makes other options for the performance.

Computer programs, parameter tables and coefficients are stored in the read only memory 12. Music data codes representative of pieces of music are further stored in the read only memory 12. Other music data codes representative of other pieces of music are stored in the random access memory 13 together with pieces of text data, flags. The random access memory 13 further offers a working memory to the central processing unit 11. The music data codes are transferred from the external memory device 18 to the random access memory 13, or are supplied from a musical instrument such as, for example, an electric keyboard through the MIDI interface 14 to the random access memory in a real time fashion. Otherwise, the music data codes may be transferred from the MIDI interface 14 to the external memory device 18, and are temporarily stored therein.

The timer 16 measures a lapse of time from initiation of a performance, and gives timing for timer interruption to the central processing unit 11. The timer 16 may be implemented by software.

The central processing unit 11 sequentially fetches the instruction codes of the computer programs from the read only memory 12, and processes the music data codes stored in the read only memory 12 or random access memory 13. The central processing unit 11 determines the player's fingers SOL to be activated through the data processing, and requests the driver circuit 17 to supply the driving signal to the solenoid-operated actuators 21 of the selected player's fingers SOL. The data processing will be hereinafter described in detail.

Music Data Codes and Contents of Tables

Figure 5C:
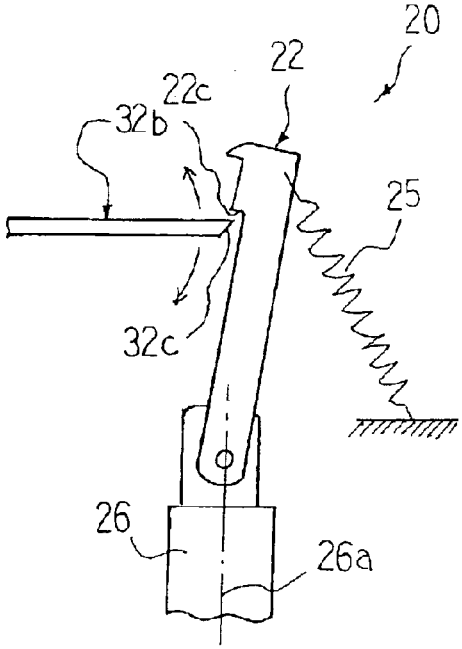

FIG. 5 shows a phrase data representative of a passage. The phrase data includes event codes representative of note events, duration data codes each representative of a time interval between the note events and an end code representative of the termination of the passage. Though not shown in FIG. 7, a tempo data code is further required for the passage, and is indicative of the tempo at which the tones are to be generated. Addresses are respectively assigned to the memory locations where the event/duration data codes are respectively stored. The central processing unit 11 assigns a pointer to the address, and sequentially accesses the event/duration data codes at the address indicated by the pointer.

The time intervals are expressed as Δt1, Δt2, Δt3, . . . The time interval represented by the duration data code is stored in the register TIME defined in the working memory. The time interval Δt1, Δt2, Δt3, . . . and register TIME will be hereinlater described in conjunction with a subroutine program executed at every timer interruption.

The note even requires some pieces of data information for realization, and a note-on or a note-off, a note number and a velocity are to be specified for the note event. The note-on and note-off are representative of the generation of a tone and the decay of the tone. The note number expresses a pitch of the tone, and is corresponding to k48, k49, . . . and k71.

One of the tables stored in the read only memory 12 is an actuator table, the contents of which are shown in FIG. 8. The actuator table defines relation among a note number kn, a count value CNT and the player's finger SOL(n) to be activated. The note number kn is from 48 to 71, and one of the note numbers 48–71 is specified by the event code. The count CNT is representative of the group of reeds, and is from zero to 3. The note number kn is combined with the count CNT, and the combinations kn-CNT relate to the player's fingers of the four tone generating stages A/B/C/D, respectively.

Figures 9, 10:
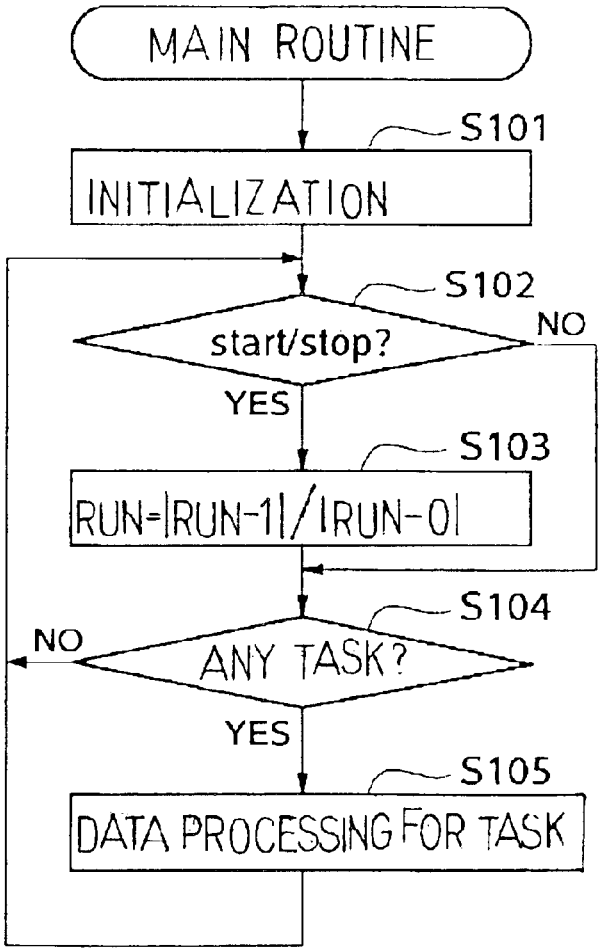
FIG. 9 is a view showing a status table representative of reed presently available for the tone generation.
FIG. 10 is a flowchart showing a main routine program.

A status table is shown in FIG. 9, and is established in the random access memory 13. The status table defines relation between the groups of reeds and reeds available for the tone generation. The groups of reeds are expressed as CNT(kn), and kn is representative of the tones k48 to k71. The reeds presently available for the tone generation are represented by CNT. As described hereinbefore, the musical instrument has four tone generating stages STA, STB, STC and STD. When the reed (kn) of the tone generating stage STA is presently available for the tone generation, the count CNT is zero. If the reed of the tone generating stage STB, reed of the tone generating stage STC or reed of the tone generating stage STD is presently available for the tone generation, the count CNT is 1, 2 or 3. Thus, the status table is representative of the current status of the reed groups CNT(kn).

Main Routine Program

FIG. 9 shows a main routine program executed by the central processing unit 11. When a user turns on the power switch on the manipulating panel 19, the central processing unit 11 starts the main routine program, and initializes the internal registers and the other system components as by step S101. Upon completion of the initialization, the central processing unit 11 checks the manipulating panel 19 to see whether or the user has manipulated the start button/stop button as by step S102. If the user does not wish to produce any piece of music, the user has not manipulated the start button/stop button, and the answer at step S102 is given negative. With the negative answer, the central processing unit 11 checks the manipulating panel 14 to see whether the user has given any instruction for a task through the manipulating panel 19 as by step S104. When the answer is given negative, the central processing unit 11 returns to step S102. Thus, the central processing unit 11 continuously checks the manipulating panel 14 for user's instructions at steps S102 and S104.

The user is assumed to manipulate the start/stop button for initiation of the automatic playing. The answer at step S102 is given affirmative, and the central processing unit 11 sets a status flag RUN to 1, i.e., |RUN−1| as by step S103. On the other hand, if the user manipulates the start/stop button for interruption of the automatic playing, the answer at step S102 is also given affirmative, and the central processing unit 11 changes the status flag RUN to 0, i.e., |RUN−0| at step S103.

On the other hand, if the user gives an instruction for a task, the answer at step S104 is given affirmative, and the central processing unit 11 starts the data processing for the given task as by step S105. A typical example of the task is to select a piece of music from the candidates stored in the read only memory 12 and random access memory 13. Upon completion of the data processing, the central processing unit 11 returns to step S102, and reiterates the loop consisting of steps S101 to S105 until the user turns off the power switch.

Figure 11:
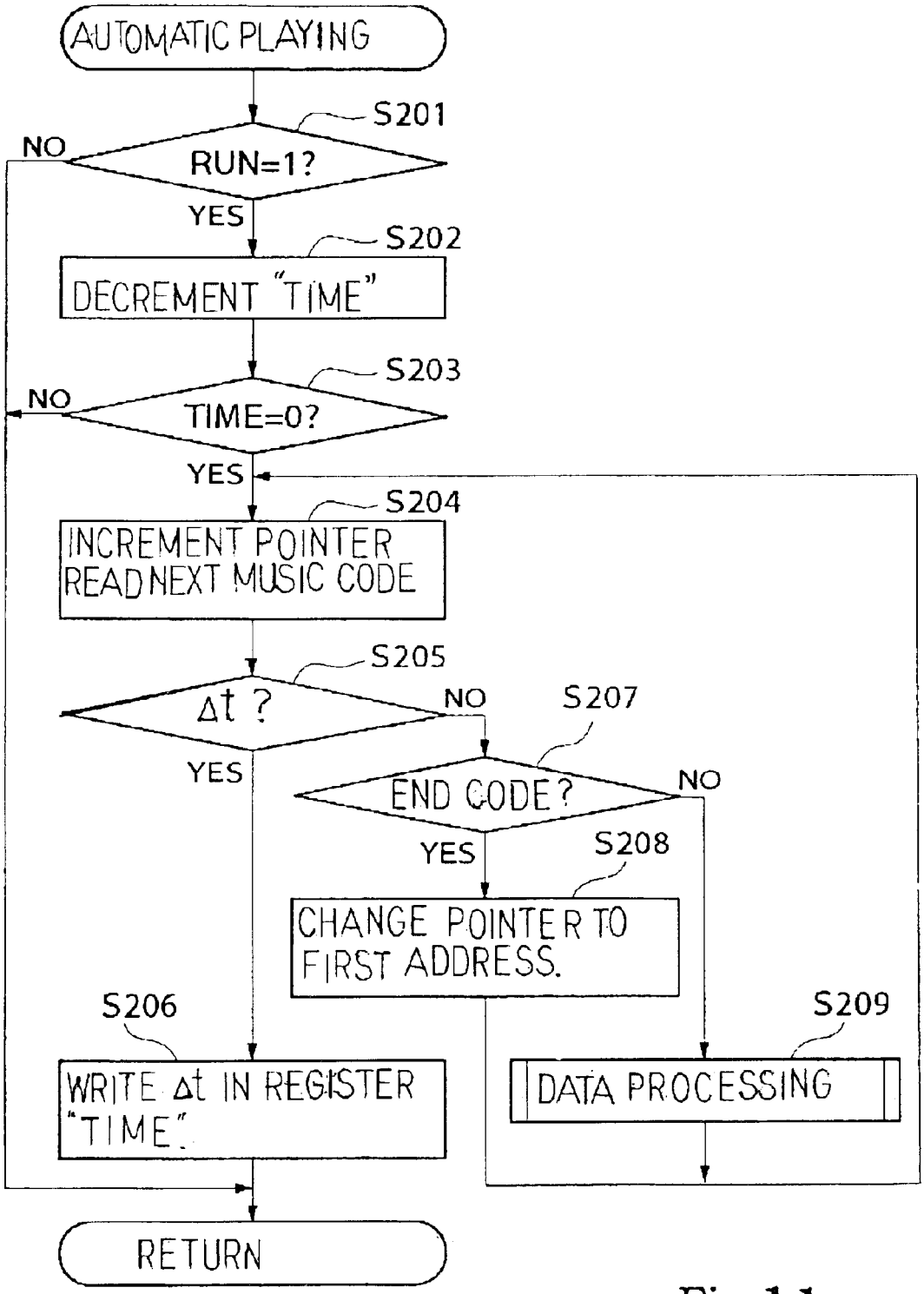
FIG. 11 is a flowchart showing a subroutine program executed at every timer interruption.

The timer 16 periodically interrupts the execution along the loop S101 to S105, and causes the central processing unit 11 to branch from the main routine program to a subroutine program shown in FIG. 11. The central processing unit 11 achieves production of a piece of music through the subroutine program. In other words, while the central processing unit 11 repeatedly executes the subroutine program, the musical instrument performs the piece of music through the automatic playing. In this instance, the timer interruption occurs at intervals of 10 milliseconds. The central processing unit 11 sets the time intervals to appropriate length depending upon the tempo adjusted by the user through the manipulating panel 19.

Upon entry into the subroutine program, the central processing unit 11 checks the status flag RUN to see whether or not the user has instructed to produce the piece of music as by step S201. If the user has not instructed the controller CL to produce a piece of music, the status flag RUN is zero, and the answer at step S201 is given negative. Then, the central processing unit 11 immediately returns to the main routine program.

If the user has already manipulated the start/stop button for initiation of the automatic playing, the status flag RUN is indicative of 1, and the answer at step S201 is given affirmative. With the positive answer, the central processing unit 11 sequentially fetches the music data codes representative of the piece of music from the read only memory 12 or random access memory 13. When the central processing unit 11 fetches a new duration data code, the central processing unit 11 transfers the new duration data code to the register TIME in the working memory for storing it therein, and decrements the value stored in the register TIME by 1 as by step S202. If the duration data code has been already stored in the working memory TIME, the central processing unit 11 merely decrements the value by 1.

Subsequently, the central processing unit 11 checks the register TIME to see whether or not the value has reached zero as by step S203. When the value is greater than zero, the answer at step S203 is given negative, and the central processing unit 11 returns to the main routine program, because the time interval indicated by the duration data code has not been expired, yet. Thus, the central processing unit 11 decrements the value stored in the register TIME at every timer interruption.

When the central processing unit 11 finds the value stored in the register TIME zero, the answer at step S203 is given affirmative, and the central processing unit 11 increments the pointer indicative of the address to be accessed. The central processing unit 11 transfers the address indicated by the pointer to the read only memory 12 or random access memory 13, and reads out the next music data code, i.e., the event code or duration data code therefrom as by step S204.

Subsequently, the central processing unit checks the music data code read out from the memory 12/13 to see whether or not the music data code represents the time interval, i.e., Δt as by step S205. When the central processing unit 11 fetches the duration data code, the answer is given affirmative, and the central processing unit 11 writes the time interval Δt in the register TIME as by step S206 Upon completion of the job at step S206, the central processing unit 11 returns to the main routine program. The value stored in the register TIME is decremented at every timer interruption at step S202.

If the read-out music data code is not the duration data code, the answer at step S205 is given negative, and the central processing unit 11 checks the music data code to see whether or not an end code has been read out from the memory 12/13 as by step S207. The end code represents the completion of the performance on the piece of music so that the central processing unit 11 changes the pointer to the first address where the first music data code is to be stored as by step S208, and returns to step S204. If the user manipulates the start/stop button for interrupting the automatic playing, the status flag RUN is changed to zero, and the central processing unit 11 immediately returns to the main routine program after the entry into the subroutine program at every timer interruption (see step S201). For this reason, the controller CL keeps the musical instrument stand-idol until the user instructs the controller CL to restart the automatic playing.

On the other hand, when the read-out music data codes is an event code, the answer at step S207 is given negative, and the central processing unit 11 processes the event code for generating a tone through an appropriate reed in the reed group or achieving another task as by step S209. The data processing at step S209 will be hereinlater described in detail with reference to FIG. 12.

Thus, the central processing unit executes the subroutine program at every timer interruption for generating tones along the piece of music selected by the user.

Figure 12:
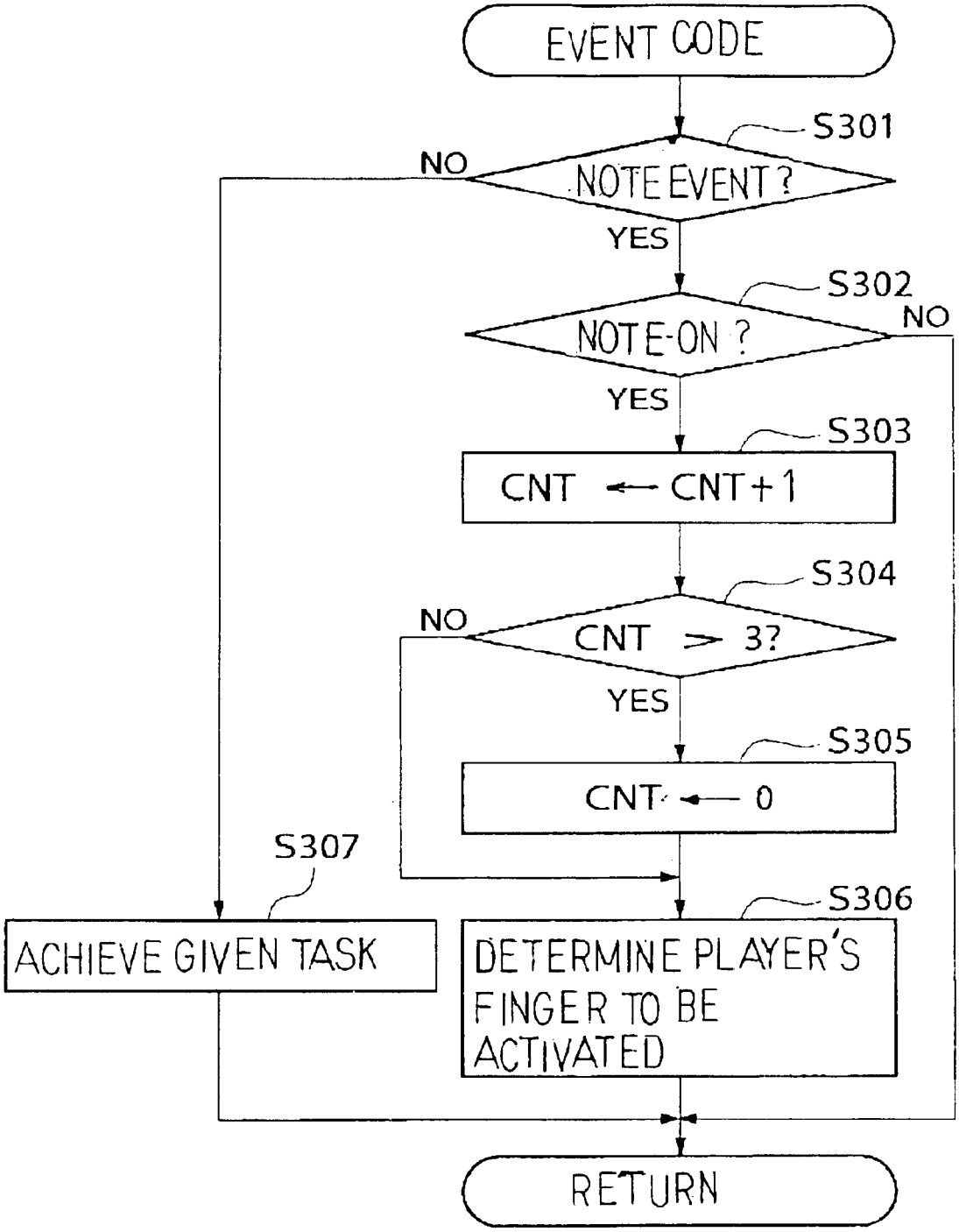
FIG. 12 is a flowchart showing a subroutine program executed for event codes.

FIG. 12 shows a subroutine program to be executed by the central processing unit at step S209. Upon entry into the subroutine program, the central processing unit 11 checks the music data code to see whether event code represents a note event as by step S301. If the answer is given negative, the central processing unit 11 achieves the given task as by step S307, and, thereafter, returns to the main routine program.

On the other hand, when the event code represents the note event, the answer is given affirmative, and the central processing unit 11 checks the event code to see whether or not the note-on event is to be requested as by step S302. If the event code represents the note-off, the answer is given negative, and the central processing unit 11 returns to the main routine program.

Figure 7:
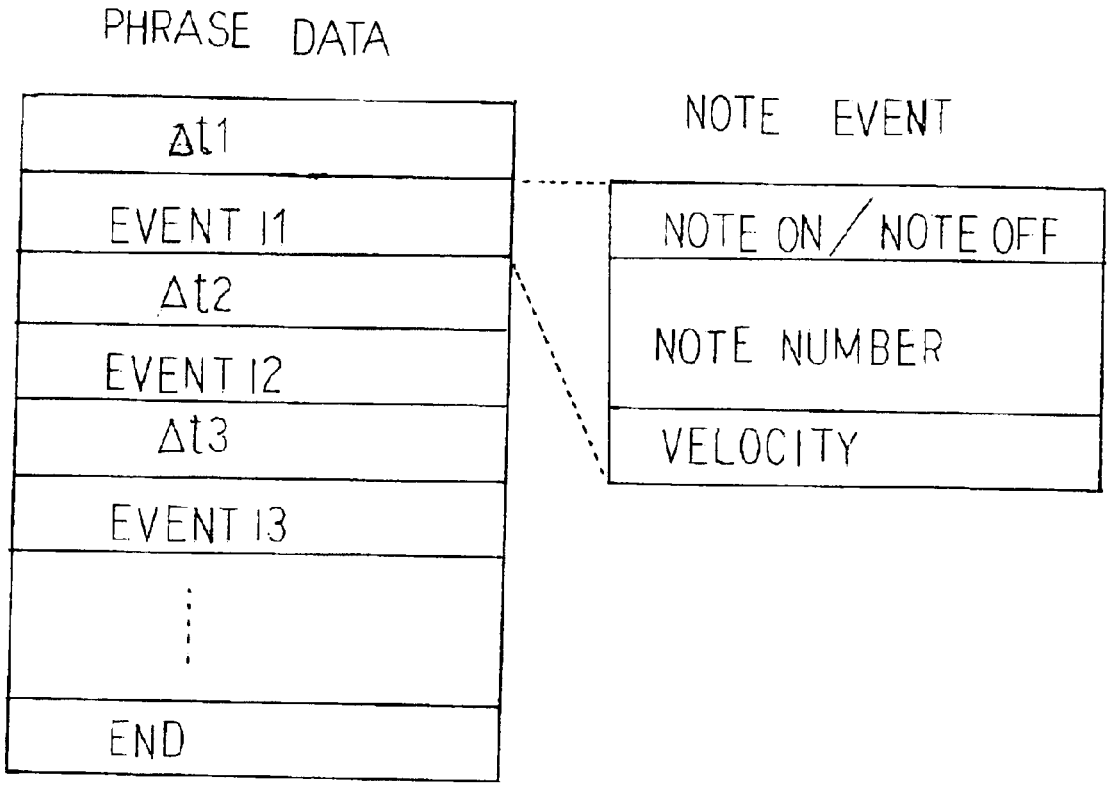
FIG. 7 is a view showing a structure of phrase data to be executed by a central processing unit.

When the event code represents the note-on, the answer at step S302 is given affirmative, and the central processing unit 11 fetches the data codes representative of the note number and velocity (see FIG. 7). The central processing unit 11 specifies the reed group CNT(kn) assigned the tone kn to be generated. Then, the central processing unit 11 fetches the current value of the count CNT stored for the specified reed group CNT(kn) from the status table (see FIG. 9), and increments the count CNT by 1 as by step S303.

Subsequently, the central processing unit 11 checks the count CNT to see whether or not the value is greater than 3 as by step S304. In this instance, the musical instrument has four tone generating stages STA/STB/STC/STD, to which values 0, 1, 2 and 3 are assigned. If the current value CNT has been incremented to 4, the answer at step S304 is given positive, and the central processing unit 11 changes the count CNT to zero as by step S305. Thus, the central processing unit 11 changes the tone generating stage ST from one to another through the execution at steps S303, S304 and S305. If the tone kn was previously generated through the reed incorporated in the tone generating stage STA, STB, STC or STD, the tone is to be generated through the reed incorporated in the tone generating stage STB, STC, STD or STA. The tone is never generated by the tone generating stage ST used in the previous tone generation. For this reason, the vibrating reed is never plucked with the pick 22.

Subsequently, the central processing unit 11 combines the note number kn with the count CNT. The central processing unit 11 accesses the actuator table in the read only memory (see FIG. 8), and reads out the code assigned a player's finger specified by the combination of note number (kn) and count value (CNT). Thus, the central processing unit 11 determines the player's finger to be activated as by step S306, and requests the driver circuit 17 to supply the driving signal to the solenoid-operated actuator 21 incorporated in the player's finger SOL. For example, if the note number kn and counter value CNT are 49 and 2, respectively, the player's finger to be activated is SOLC(k49) as shown in FIG. 8.

The driver circuit 17 supplies the driving signal to the solenoid-operated actuator 21 of the player's finger SOLC (k49), which is incorporated in the tone generating stage STC. Then, the magnetic field is created in the solenoid-operated actuator 21. The pick 22 is inwardly inclined, and the plunger 26 upwardly projects from the bobbin 23. The pick 22 is brought into contact with the tip 32*c* of the reed 32*b*(k49), and plucks the reed 32*b*(k49) for generating the tone k49. When the elastic force exceeds the magnetic force, the pick 22 is outwardly inclined. The driver circuit 17 removes the magnetic force upon reaching the upper dead point, and the plunger 26 and pick 22 are moved toward the rest position. The spring 25 keeps the pick 22 outwardly inclined. For this reason, the pick 22 does not interfere with the vibrating reed 32*b*(k49).

As will be understood from the foregoing description, the controller CL selectively activates the reeds of the group assigned the tone to be generated. Any reed, which generated the tone in the previous note-on event, is never used in the next tone generation. Even if a tone is repeatedly generated at extremely short intervals, the tone generating stages STA/STB/STC/STD are sequentially used for the repetition. This means that the vibrating reed is never plucked. This results in the clear tone. Any harsh tone is never generated in the musical instrument according to the present invention.

Moreover, the vibrating reed 32*b* is never forcibly decayed. The reverberations make the tones harmonized. Thus, the musical instrument according to the present invention enhances the artistic representation through the reverberations.

The reeds 32*b* are independently plucked with the player's fingers SOL. This feature is desirable, because more than one tone is concurrently produced for a chord. Moreover, when the music data codes are replaced with another set of music data codes, the automatic player performs another piece of music on the basis of the new set of music data codes. It is not required to change the physical structure of the automatic player. Thus, the musical instrument according to the present invention can answer any user's request for the automatic playing.

In the subroutine program shown in FIG. 12, when the event code represents the note-on, the count value CNT is incremented. The count value may be incremented when the event code represents the note-off.

Second Embodiment

Another musical instrument implementing the second embodiment is similar in structure to the musical instrument shown in FIGS. 1, 2, 4A and 4B, and includes a controller, which is similar in system configuration to the controller CL shown in FIG. 6. For this reason, the component parts and system components of the musical instrument implementing the second embodiment are hereinafter labeled with the references designating corresponding component parts and system components of the first embodiment without detailed description for avoiding repetition.

One of the differences from the first embodiment is how a reed is selected from the reed group. In the first embodiment, the reed available for the tone generation is circulated through the reed group. In the musical instrument implementing the second embodiment, the controller CL takes the lapse of time between the previous tone generation and the present time into account. The actuator table (see FIG. 8) and status table (see FIG. 9) are also established in the random access memory 13. Another status table is further established in the random access memory 13 for the lapse of time.

FIG. 13 shows the status table for the lapse of time. Time counters TCNT(kn) are respectively assigned to the reed groups. As described hereinbefore, the reed groups are used for generating the tones kn, respectively, so that "kn" correlates the reed groups with the time counters TCNT. For example, the time counter TCNT(k48) is indicative of the lapse of time from the previously generated tone k48.

The main routine program for the second embodiment is similar to the main routine program shown in FIG. 10 except the initialization. In the initialization, the central processing unit 11 sets all the time counters TCNT(kn) to a initial value I.V. In this instance, the initial value I.V. is 501. The time counters TCNT(kn) are incremented by one at every timer interruption. If a time counter TCNT(kn) presently has a value less than a threshold value such as, for example, 500. The lapse of time is short from the tone generation through vibrations of a reed of the associated reed group. This means that the reed may possibly vibrate. For this reason, another reed is to be selected from the reed group.

Figure 14:
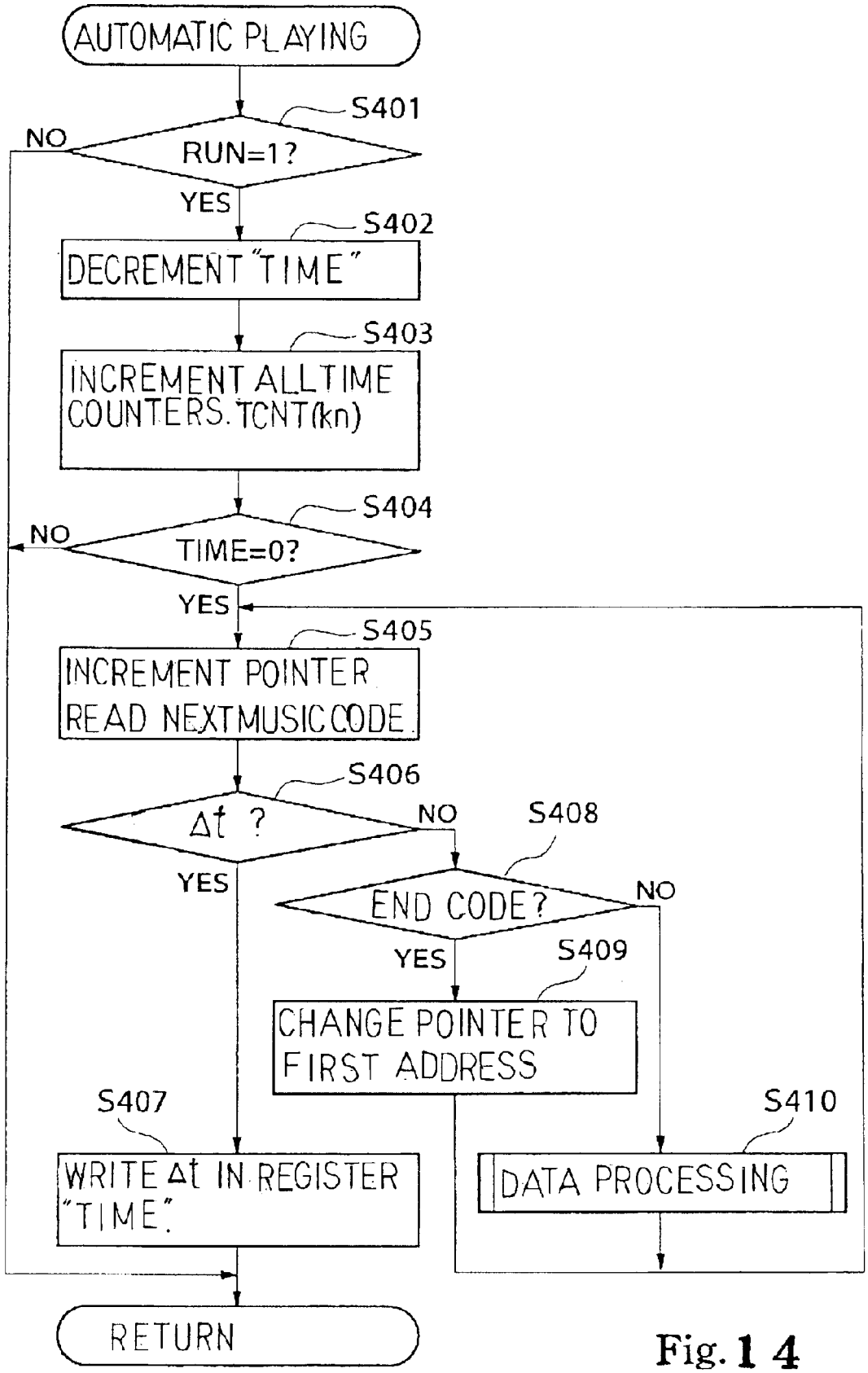
FIG. 14 is a flowchart showing a subroutine program executed at every timer interruption.

When a user powers the controller CL, the central processing unit 11 carries out the initialization (see step S101 in FIG. 10), and reiterates the loop consisting of steps S102 to S105. The timer interruption occurs at the time intervals of 10 milliseconds, and the main routine program branches to a subroutine program for the automatic playing shown in FIG. 14. The time intervals are variable together with the tempo given by the user through the manipulating panel 19.

Upon entry into the subroutine program at the timer interruption, the central processing unit 11 checks the status flag RUN to see whether or not the user has instructed to produce the piece of music as by step S401. If the user has not instructed the controller CL to produce a piece of music, the status flag RUN is zero, and the answer at step S401 is given negative. Then, the central processing unit 11 immediately returns to the main routine program.

If the user has already manipulated the start/stop button for initiating the automatic playing, the status flag RUN is indicative of 1, and the answer at step S401 is given affirmative. With the positive answer, the central processing unit 11 sequentially fetches the music data codes representative of the piece of music from the read only memory 12 or random access memory 13. When the central processing unit 11 fetches a new duration data code, the central processing unit 11 transfers the new duration data code to the register TIME in the working memory for storing it therein, and decrements the value stored in the register TIME by 1 as by step S402. If the duration data code has been already stored in the working memory TIME, the central processing unit 11 merely decrements the value by 1.

Subsequently, the central processing unit 11 increments all the time counters TCNT(48) to TCNT(71) by one as by step S403, and checks the register TIME to see whether or not the value has reached zero as by step S404. When the value is greater than zero, the answer at step S404 is given negative, and the central processing unit 11 returns to the main routine program, because the time interval indicated by the duration data code has not been expired, yet. Thus, the central processing unit 11 decrements the value stored in the register TIME and the values stored in the time counters TCNT(kn) at every timer interruption.

When the central processing unit 11 finds the value stored in the register TIME zero, the answer at step S404 is given affirmative, and the central processing unit 11 increments the pointer indicative of the address of the memory 12/13 to be accessed. The central processing unit 11 transfers the address indicated by the pointer to the read only memory 12 or random access memory 13, and reads out the next music data code, i.e., the event code or duration data code from the memory 12/13 as by step S405.

Subsequently, the central processing unit checks the music data code read out from the memory 12/13 to see whether or not the music data code represents the time interval, i.e., Δt as by step S406. When the central processing unit 11 fetches the duration data code, the answer is given affirmative, and the central processing unit 11 writes the time interval Δt in the register TIME as by step S407. Upon completion of the job at step S407, the central processing unit 11 returns to the main routine program. The value newly stored in the register TIME is decremented at every timer interruption at step S402.

If the read-out music data code is not the duration data code, the answer at step S406 is given negative, and the central processing unit 11 checks the music data code to see whether or not an end code has been read out from the memory 12/13 as by step S408. The end code represents the completion of the performance on the piece of music so that the central processing unit 11 changes the pointer to the first address where the first music data code is to be stored as by step S409, and returns to step S405. If the user manipulates the start/stop button for interrupting the automatic playing, the status flag RUN is changed to zero, and the central processing unit 11 immediately returns to the main routine program after the entry into the subroutine program at every timer interruption (see step S401). For this reason, the controller CL keeps the musical instrument stand-idol until the user instructs the controller CL to restart the automatic playing.

On the other hand, when the read-out music data codes is an event code, the answer at step S408 is given negative, and the central processing unit 11 processes the event code for generating a tone through an appropriate reed in the reed group or achieving another task as by step S410. The data processing at step S410 will be hereinlater described in detail with reference to FIG. 15.

Thus, the central processing unit executes the subroutine program at every timer interruption for generating tones along the piece of music selected by the user.

Figure 15:
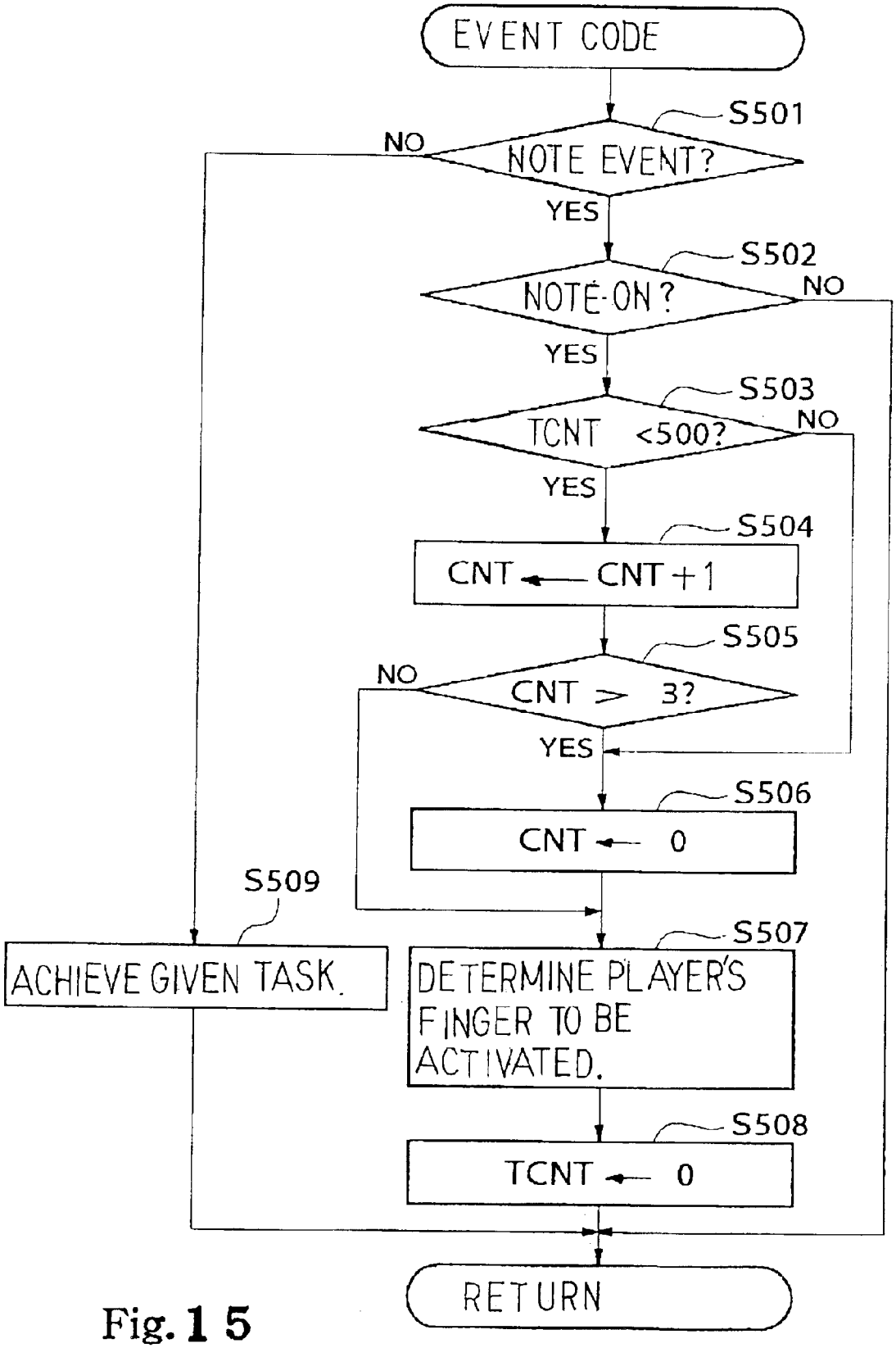
FIG. 15 is a flowchart showing a subroutine program executed for event codes.

FIG. 15 shows a subroutine program to be executed by the central processing unit at step S410. When the central processing unit 11 read out the event code, the central processing unit 11 checks the music data code to see whether event code represents a note event as by step S501. If the answer is given negative, the central processing unit 11 achieves the given task as by step S509, and, thereafter, returns to the main routine program.

On the other hand, when the event code represents the note event, the answer is given affirmative, and the central processing unit 11 checks the event code to see whether or not the note-on event is to be requested as by step S502. If the event code represents the note-off, the answer is given negative, and the central processing unit 11 returns to the main routine program.

When the event code represents the note-on, the answer at step S502 is given affirmative, and the central processing unit 11 fetches the data codes representative of the note number and velocity (see FIG. 7). The central processing unit 11 specifies the reed group CNT(kn) assigned the tone kn to be generated.

Subsequently, the central processing unit 11 checks the time counter TCNT(kn) associated with the reed group CNT(kn) to see whether or not the value TCNT is less than 500 as by step S503. If the value is less than 500, the lapse of time from the previous tone generation is short, and the previously used reed 32*b* may possibly vibrate. For this reason, the central processing unit 11 decides to change the reed 32*b* to be used for the tone generation. The central processing unit 11 increments the value CNT as by step S504, and checks the value CNT to see whether or not the incremented value CNT is greater than 3 as by step S505. If the answer is given affirmative, the central processing unit 11 changes the value to zero as by step S506. Thus, the value CNT is circulated between zero to 3. After step S506, the central processing unit proceeds to step S507.

When the value CNT is equal to or less than 3, the answer at step S505 is given negative, and the central processing unit 11 proceeds to step S507 without execution at step S506.

On the other hand, if the time counter TCNT(kn) exceeds 500, the lapse of time from the previous tone generation is long, and the vibrations have been already decayed. This means that any one of the reeds 32*b* of the reed group CNT(kn) is available for the tone generation. For this reason, the central processing unit proceeds to step S506 without execution at steps S504 and S505. The value CNT is changed to zero at step S506. Thus, when the vibrations in the previous tone generation is presume to have been already decayed, the central processing unit 11 always decides the tone generation stage STA to be used in the present tone generation. Upon completion of the job at step S506, the central processing unit 11 proceeds to step S507.

Subsequently, the central processing unit 11 combines the note number kn with the count CNT. The central processing unit 11 accesses the actuator table in the read only memory (see FIG. 8), and reads out the code assigned a player's finger specified by the combination of note number (kn) and count value (CNT). Thus, the central processing unit 11 determines the player's finger to be activated as by step S507, and requests the driver circuit 17 to supply the driving signal to the solenoid-operated actuator 21 incorporated in the player's finger SOL. For example, if the note number kn and counter value CNT are 49 and 0, respectively, the player's finger to be activated is SOLA(k49) as shown in FIG. 8.

The driver circuit 17 supplies the driving signal to the solenoid-operated actuator 21 of the player's finger SOLA (k49), which is incorporated in the tone generating stage STA. Then, the magnetic field is created in the solenoid-operated actuator 21. The pick 22 is inwardly inclined, and the plunger 26 upwardly projects from the bobbin 23. The pick 22 is brought into contact with the tip 32*c* of the reed 32*b*(k49) of the daisy reed wheel 32A, and plucks the reed 32*b*(k49) of the daisy reed wheel 32A for generating the tone k49.

When the elastic force exceeds the magnetic force, the pick 22 is outwardly inclined. The driver circuit 17 removes the magnetic force upon reaching the upper dead point, and the plunger 26 and pick 22 are moved toward the rest position. The spring 25 keeps the pick 22 outwardly inclined. For this reason, the pick 22 does not interfere with the vibrating reed 32*b*(k49).

After the central processing unit 11 requests the driver circuit 17 to activate the selected player's finger, the central processing unit 11 proceeds to step S508, and changes the value TCNT of the associated time counter TCNT(kn) to zero. The time counter TCNT(kn) will be incremented by one at every timer interruption so as to indicate the lapse of time TCNT from the present tone generation with the time counter TCNT(kn).

As will be understood, the musical instrument implementing the second embodiment properly uses the four tone generating stages STA/STB/STC/STD. When the automatic player repeatedly generates a tone at short intervals, the controller CL changes the tone generating stage ST from the previously used one to another. In this case, the tone generating stage is changed from STA through STB and STC to STD. On the other hand, when the automatic player generates a tone after a long time period, the controller CL fixedly uses the tone generating stage STA. Even through the daisy reed wheels 32A/32B/32C/32D are designed to generate the tones k48 to k71, it is impossible to strictly make the tone kn equal in pitch to one another. From this viewpoint, the musical instrument implementing the second embodiment is desirable, because the other tone generating stages STB, STC and STD are exceptionally used for the tone generation. Such a precise control requires only the time counters TCNT(kn), which is a software implementation. Thus, the musical instrument implementing the second embodiment is as simple as the musical instrument implementing the first embodiment.

In the above-described second embodiment, 500 is an example of the threshold. When the reeds 32*b* exhibit different vibration characteristics, the threshold is to be changed.

Third Embodiment

Yet another musical instrument implementing the third embodiment is similar in structure to the musical instrument shown in FIGS. 1, 2, 4A and 4B, and includes a controller, which is similar in system configuration to the controller CL shown in FIG. 6. For this reason, the component parts and system components of the musical instrument implementing the third embodiment are hereinafter labeled with the references designating corresponding component parts and system components of the first embodiment without detailed description for avoiding repetition.

One of the differences from the second embodiment is that the automatic player selects either multi-reed tone generation or single reed tone generation. The automatic player generates a tone through a single reed 32*b* in the single reed tone generation. On the other hand, when the player selects the multireed tone generation, the automatic player concurrently gives rise to vibrations in plural reeds 32*b* in the reed group Thus, deep tones are generated through the multi-reed tone generation.

The musical instrument implementing the third embodiment requires another actuator table for generating tones through the single reed tone generation or multi-reed tone generation. The other tables are similar to those of the second embodiment. For this reason, the actuator table is firstly described with reference to FIG. 16. The actuator table correlates the combinations of note number kn and counter value CNT with player's finger/fingers SOL. When the counter value CNT is 1 or 3, the central processing unit 11 generates tones through the single reed tone generation so that the actuator table correlates the combinations of note numbers kn and counter value CNT of 1 or 3 with the player's fingers SOL of the tone generating stage STB or tone generating stage STD. On the other hand, when the counter value CNT is zero or 2, the central processing unit 11 generates tones through the multi-reed tone generation so that the actuator table correlates the combinations of note number kn and counter value of zero or 2 with the two player's fingers SOL of the tone generation stages STA and STC.

If a tone is repeatedly generated in short intervals, the central processing unit 11 changes the tone generating stage ST from STB through STA+STC to STD. For this reason, any vibrating reed is never plucked with the associated player's finger SOL. Thus, controller CL prevents the reeds 32*b* from generating the harsh tone. On the other hand, when a tone is repeated at a long interval, the central processing unit 11 selects the multi-reed tone generation for generating the deep tones.

The main routine program, subroutine program at the timer interruption and subroutine program for data processing on the event codes are similar to those of the second embodiment. For this reason, no further description is incorporated hereinafter.

As will be understood from the foregoing description, the musical instrument implementing the third embodiment achieves the advantage by virtue of the multi-reed tone generation as well as all the advantages of the first and second embodiments.

In a modification, the tone generating stages STA and STC may be assigned the combination of note numbers kn and the counter value of zero. In this instance, when the counter value is 2, the central processing unit 11 selects the single reed tone generation, and activates the player's finger SOL of the tone generating stage STA, by way of example.

Fourth Embodiment

Still another musical instrument implementing the fourth embodiment is similar in structure to the musical instrument shown in FIGS. 1, 2, 4A and 4B, and includes a controller, which is similar in system configuration to the controller CL shown in FIG. 6. For this reason, the component parts and system components of the musical instrument implementing the third embodiment are also labeled with the references designating corresponding component parts and system components of the first embodiment without detailed description for avoiding repetition. The music data codes are, by way of example, expressed as those shown in FIG. 7, and the status table used in the fourth embodiment is same as that of the first embodiment shown in FIG. 9. Either actuator table shown in FIG. 8 or 16 is available for the musical instrument implementing the fourth embodiment. However, the actuator table shown in FIG. 16 is assumed to be established in the random access memory 13. The time counters TCNT(kn) are not required for the controller CL.

In the first embodiment, the reeds 32*b* are sequentially changed in each reed group for repeatedly generating the tone at short intervals. The controller CL incorporated in the fourth embodiment looks ahead tones to be generated, and determines the reed or reeds to be driven for vibrations An event buffer and a key buffer are defined in the random access memory 13 for the look-ahead as will be described hereinlater.

Figure 17:
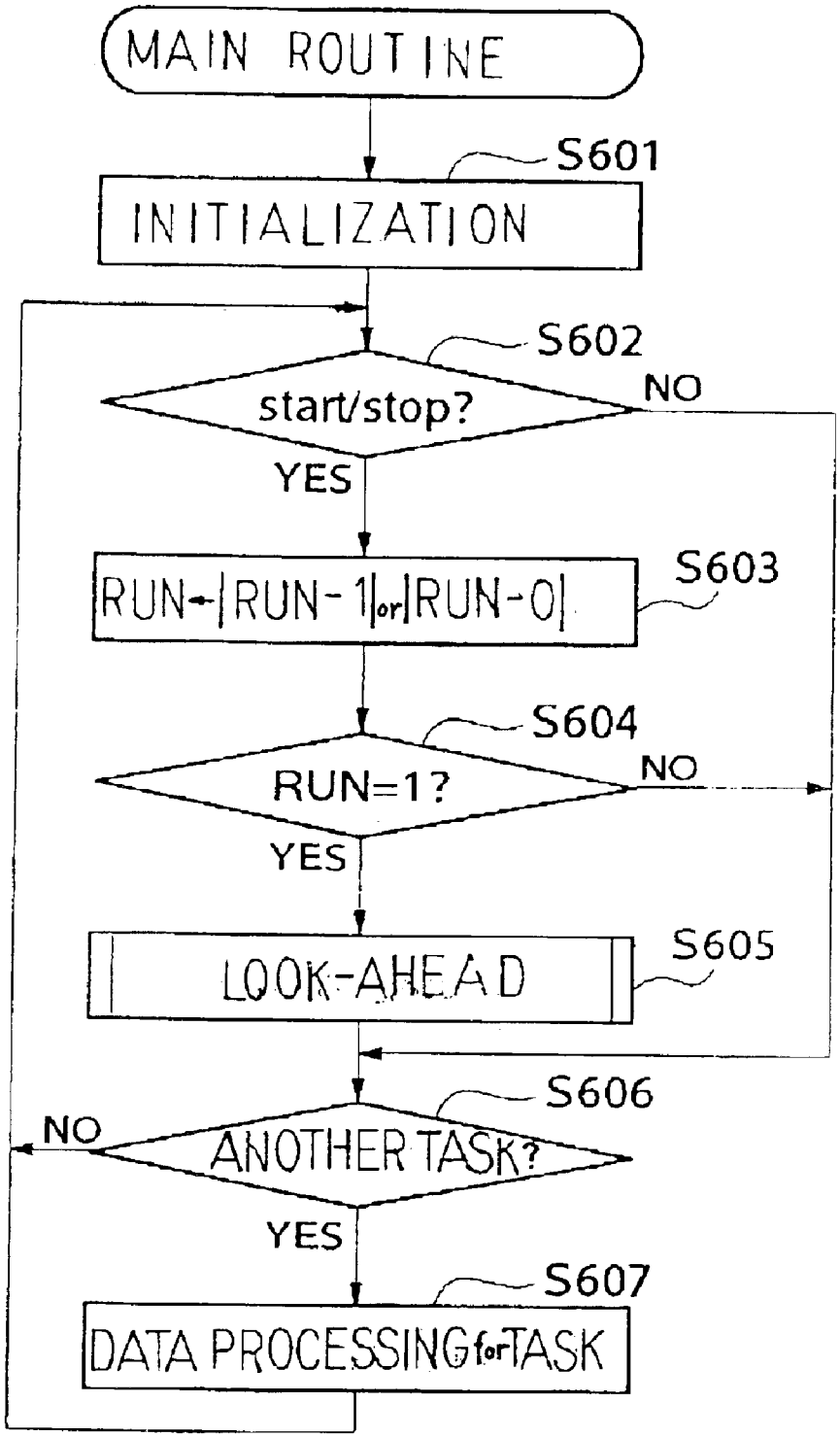
FIG. 17 is a flowchart showing a main routine program executed for a controller incorporated in still another musical instrument.

FIG. 17 shows a main routine program executed by the central processing unit 11. When a user powers the controller CL, the central processing unit starts to execute the main routine program. The central processing unit 11 firstly initializes the internal registers and other system components as by step S601. The actuator table, status table, time counters, flags, event buffers and key buffer are defined in the random access memory 13.

Upon completion of the initialization, the central processing unit 11 checks the manipulating panel 19 to see whether or not the user has manipulated the start/stop button after the previous loop as by step S602. If the user has manipulated the start/stop button for initiating the automatic playing or interrupting the performance, the answer at step S602 is given affirmative, and the central processing unit 11 sets the flag RUN to 1 or zero as by step S603. The flag |RUN−1| is indicative of the automatic playing, and the flag |RUN−1| is indicative of the waiting state. On the other hand, if the user has not manipulated the start/stop button after the previous loop, the answer is given negative, and the central processing unit 11 proceeds to step S606 without execution at steps S603/S604/S605.

Upon completion of the job at step S603, the central processing unit 11 checks the flag RUN to see whether or not the value is 1 as by step S604. If the flag RUN is indicative of the waiting state, the flag RUN has been set to zero, and the answer at step S604 is given negative. Then, the central processing unit 11 proceeds to step S606. On the other hand, when the flat RUN is indicative of the request for the automatic playing, i.e., 1, the answer at step S604 is given affirmative, and the central processing unit 11 enters a subroutine program for the look-ahead as by step S605. The subroutine program will be hereinafter described with reference to FIG. 18.

When the central processing unit 11 returns from the subroutine program to the main routine program, the central processing unit 11 checks the manipulating panel 14 to see whether the user has given any instruction for a task through the manipulating panel 19 after the previous loop as by step S606. When the answer is given negative, the central processing unit 11 returns to step S602. Thus, the central processing unit 11 continuously checks the manipulating panel 14 for user's instructions at steps S602 and S606.

If the user has given an instruction for a task after the previous loop, the answer at step S604 is given affirmative, and the central processing unit 11 starts the data processing for the given task as by step S607. A typical example of the task is to select a piece of music from the candidates stored in the read only memory 12 and random access memory 13. Upon completion of the data processing, the central processing unit 11 returns to step S602, and reiterates the loop consisting of steps S602 to S607 until the user turns off the power switch.

Upon entry into the subroutine program for the look-ahead, the central processing unit 11 checks the flag RUN to see whether or not the user instructed the controller CL the automatic playing, i.e., RNU=1 as by step S701. If the controller CL is to be in the waiting state, the flag RUN has been set to zero, and the answer at step S701 is given negative. Then, the central processing unit 11 immediately returns to the main routine program.

On the other hand, if the user has instructed the controller CL the automatic playing, the flat RUN has bee set to 1, and the answer at step S701 is given affirmative. Then, the central processing unit 11 increments the pointer, and reads out a music data code from the address indicated by the pointer as by step S702. The central processing unit 11 checks the music data code to see whether or not the read-out music data code is a duration data code as by step S703. If the event code is fetched, the central processing unit 11 checks the event code to see whether or not the event code is representative of the note event as by step S704. When the event code represents the note event, the answer at step S704 is given affirmative, and the central processing unit 11 accumulates the event code in the event buffer as by step S705. Upon completion of the job, the central processing unit 11 proceeds to step S709.

If the event code does not represent the note event, the read-out music data code is to be the end code. This means that the automatic playing is to be completed. Then, the central processing unit 11 changes the pointer to the first address as by step S706, and proceeds to step S709.

On the other hand, if the read-out music data code is the duration data code, the answer at step S703 is given affirmative, and the central processing unit 11 adds the time interval expressed by the duration data code to a variable READTIME as by step S707. The central processing unit 11 determines a timing to read out the event code or codes through comparison between the variable READTIME and a predetermined time RT as will be described hereinlater in detail. The predetermined time RT is a threshold. Upon completion of the job at step S707, the central processing unit 11 accumulates the duration data code in the event buffer as by step S708, and proceeds to step S709.

The central processing unit 11 compares the variable READTIME with the threshold RT to see whether or not the variable READTIME is greater than the threshold RT as by step S709. If the variable READTIME has not reached the threshold RT, the answer is given negative, and the central processing unit 11 returns to step S702. Thus, the central processing unit 11 reiterates the loop consisting of steps S702 to S709, and accumulates the music data codes in the event buffer until the variable READTIME exceeds the threshold RT.

Figure 19:
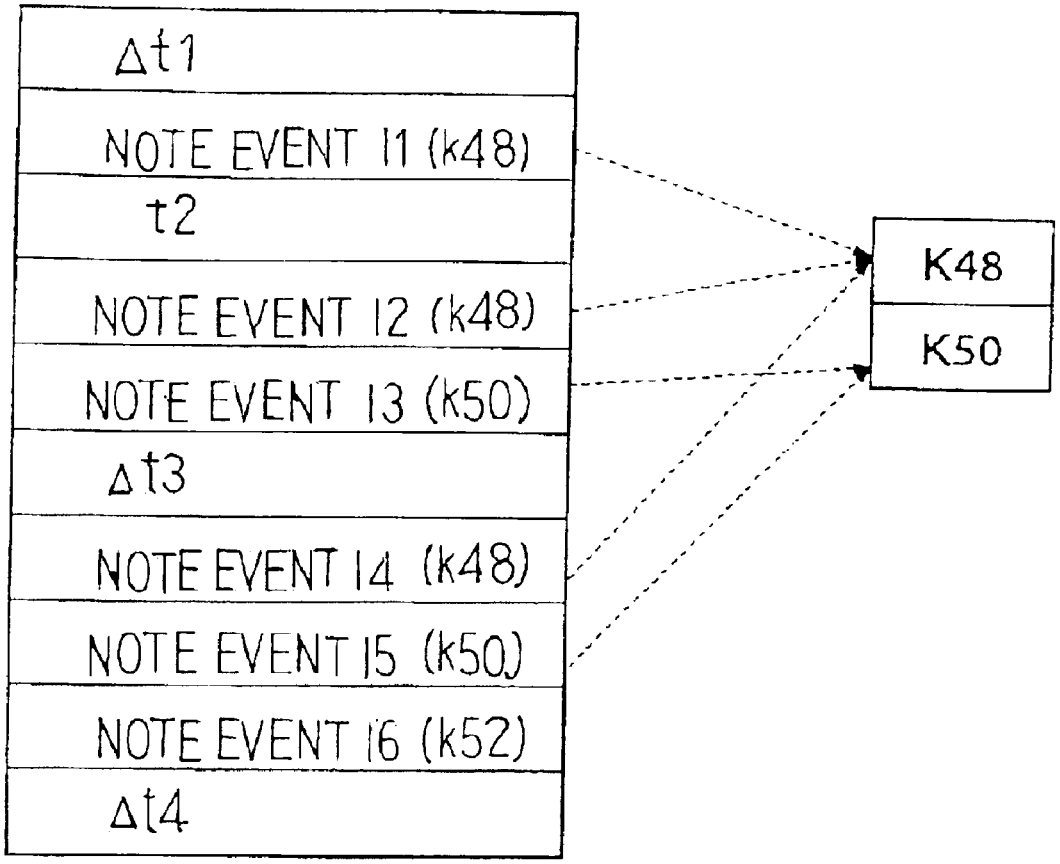
FIG. 19 is a view showing an event buffer and a key buffer used for a look-ahead.

FIG. 19 shows the event buffer and key buffer created in the random access memory 13. The duration data codes Δt1–Δt4 and event codes representative of the note event I1–I6 are accumulated in the event buffer. The event codes I1, I2 and 14 relate to the note number k48, and the event codes 13 and 15 relate to the note number k50. These music data codes have not bee processed, yet. The end code is not written in the event buffer so that the central processing unit 11 has accumulated the duration data codes and event codes representative of the note events in the event buffer. The threshold RT is assumed to be twenty seconds. For this reason, the event buffer has the capacity large enough to accumulate the duration data codes and event codes to be processed in 20 seconds. The threshold RT is variable.

Turning back to FIG. 18, when the variable READTIME exceeds the threshold RT, the answer at step S709 is changed to affirmative. Then, the central processing unit 11 searches the event buffer for the event code relating to the same note number, and registers the note number or numbers common to more than one event code as by step S710. In the event buffer shown in FIG. 19, the note number k48 is common to the note events I1, I2 and I4, and the note number k50 is common to the note events I3 and I5. In this instance, the central processing unit 11 registers the note numbers k48 and k50 in the key buffer. The note number or numbers common to plural note events are indicative of the tone or tones to be repeatedly generated in the twenty seconds. In the event buffer shown in FIG. 19, the central processing unit 11 determines that the tones k48 and k50 are to be repeatedly generated at short intervals. The note number or numbers in the key buffer are valid in each loop.

Subsequently, the central processing unit 11 eliminates the duration data codes stored in the register TIME and the event codes on which the tones have been already generated from the event buffer, and deletes the note number or numbers not common to plural note events from the key buffer as by step S711. Upon completion of the jobs at step S711, the central processing unit 11 returns to the main routine program.

Figure 18:
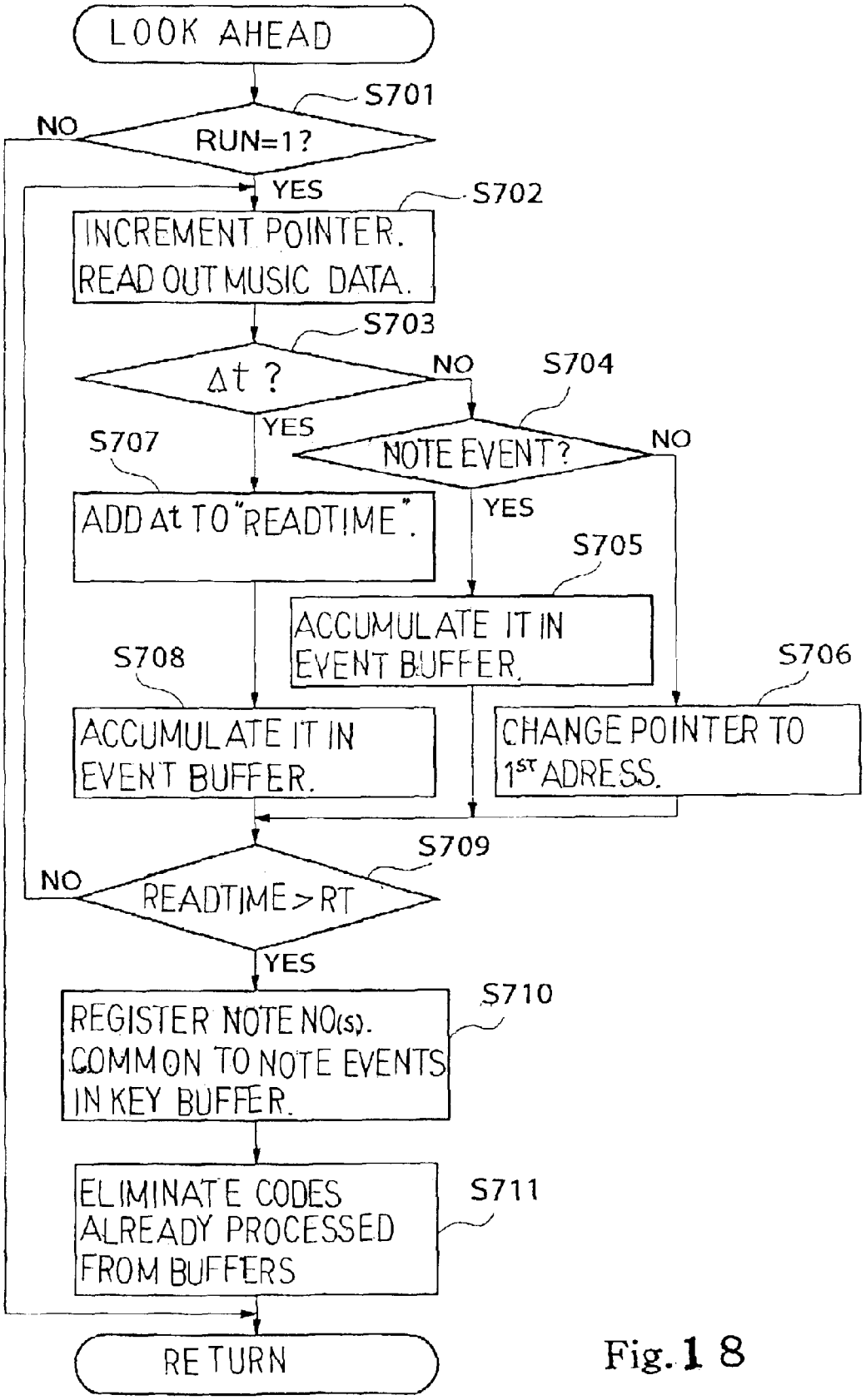
FIG. 18 is a flowchart showing a subroutine program executed for a look-ahead.

While the central processing unit 11 is reiterating the loop S602 to S607, the central processing unit 11 enters the subroutine program shown in FIG. 18 for determining the tone or tones to be generating at short intervals, and return to the loop. Thus, the central processing unit 11 looks ahead the predetermined time period, i.e., twenty seconds to see whether or not the passage contains a tone or tones to be repeatedly generated.

Figure 20:
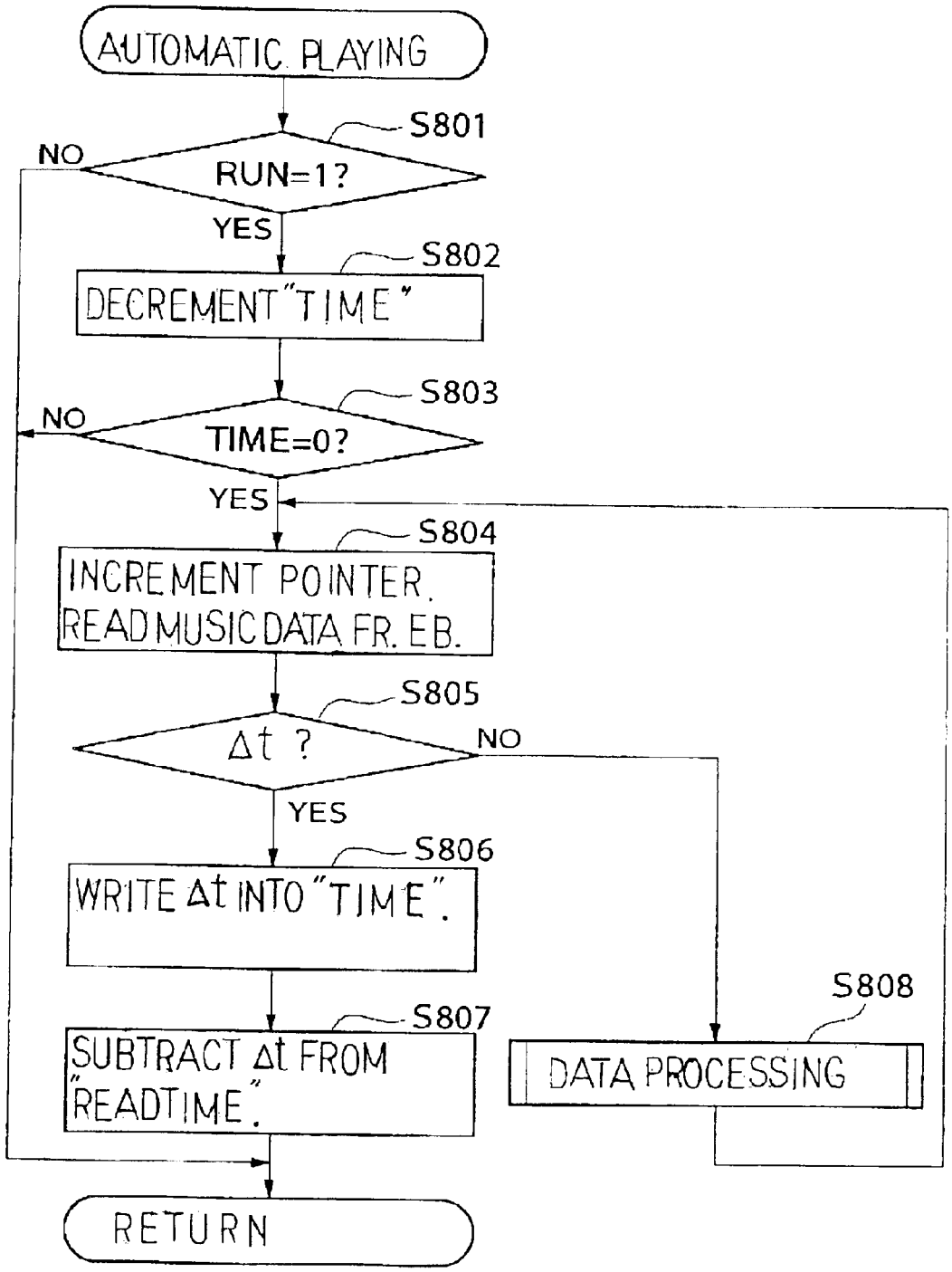
FIG. 20 is a flowchart showing a subroutine program executed at every timer interruption.

The timer interruption occurs at 10 milliseconds for generating tones along the passage. FIG. 20 shows a subroutine program executed at every timer interruption.

Upon entry into the subroutine program, the central processing unit 11 checks the status flag RUN to see whether or not the user has already instructed to produce the piece of music as by step S801. If the user has not instructed the controller CL to produce a piece of music, the status flag RUN is zero, and the answer at step S801 is given negative. Then, the central processing unit 11 immediately returns to the main routine program.

If the user has already manipulated the start/stop button for initiation of the automatic playing, the status flag RUN is indicative of 1, and the answer at step S801 is given affirmative. With the positive answer, the central processing unit 11 starts to sequentially fetch the music data codes representative of the piece of music from the read only memory 12 or random access memory 13. When the central processing unit 11 fetches a new duration data code, the central processing unit 11 transfers the new duration data code to the register TIME in the working memory for storing it therein, and decrements the value stored in the register TIME by 1 as by step S802. If the duration data code has been already stored in the working memory TIME, the central processing unit 11 merely decrements the value by 1 at step S802.

Subsequently, the central processing unit 11 checks the register TIME to see whether or not the value has reached zero as by step S803. When the value is greater than zero, the answer at step S803 is given negative, and the central processing unit 11 returns to the main routine program, because the time interval indicated by the duration data code has not been expired, yet. Thus, the central processing unit 11 decrements the value stored in the register TIME at every timer interruption.

When the central processing unit 11 finds the value stored in the register TIME zero, the answer at step S803 is given affirmative, and the central processing unit 11 increments the pointer indicative of the address to be accessed. The central processing unit 11 transfers the address indicated by the pointer to the event buffer EV, and reads out the next music data code, i.e., the event code or duration data code therefrom as by step S804.

Subsequently, the central processing unit checks the music data code read out from the event buffer EV to see whether or not the music data code represents the time interval, i.e., $\Delta t$ as by step S805. When the central processing unit 11 fetched the duration data code, the answer is given affirmative, and the central processing unit 11 writes the time interval $\Delta t$ in the register TIME as by step S806. Subsequently, the central processing unit 11 subtracts the time interval $\Delta t$ from the variable READTIME as by step S807. Upon completion of the job at step S807, the central processing unit 11 returns to the main routine program.

On the other hand, if the central processing unit read out an event code, the answer at step S805 is given negative, and the central processing unit 11 enters a subroutine program for a data processing on an event code as by step S808. When the central processing unit 11 returns form the subroutine program for the data processing on an event code to the subroutine program at every timer interruption, the central processing unit 11 returns to step S804, and reiterates the loop consisting of steps S804 to S808 until the control returns to the main routine program.

Figure 21:
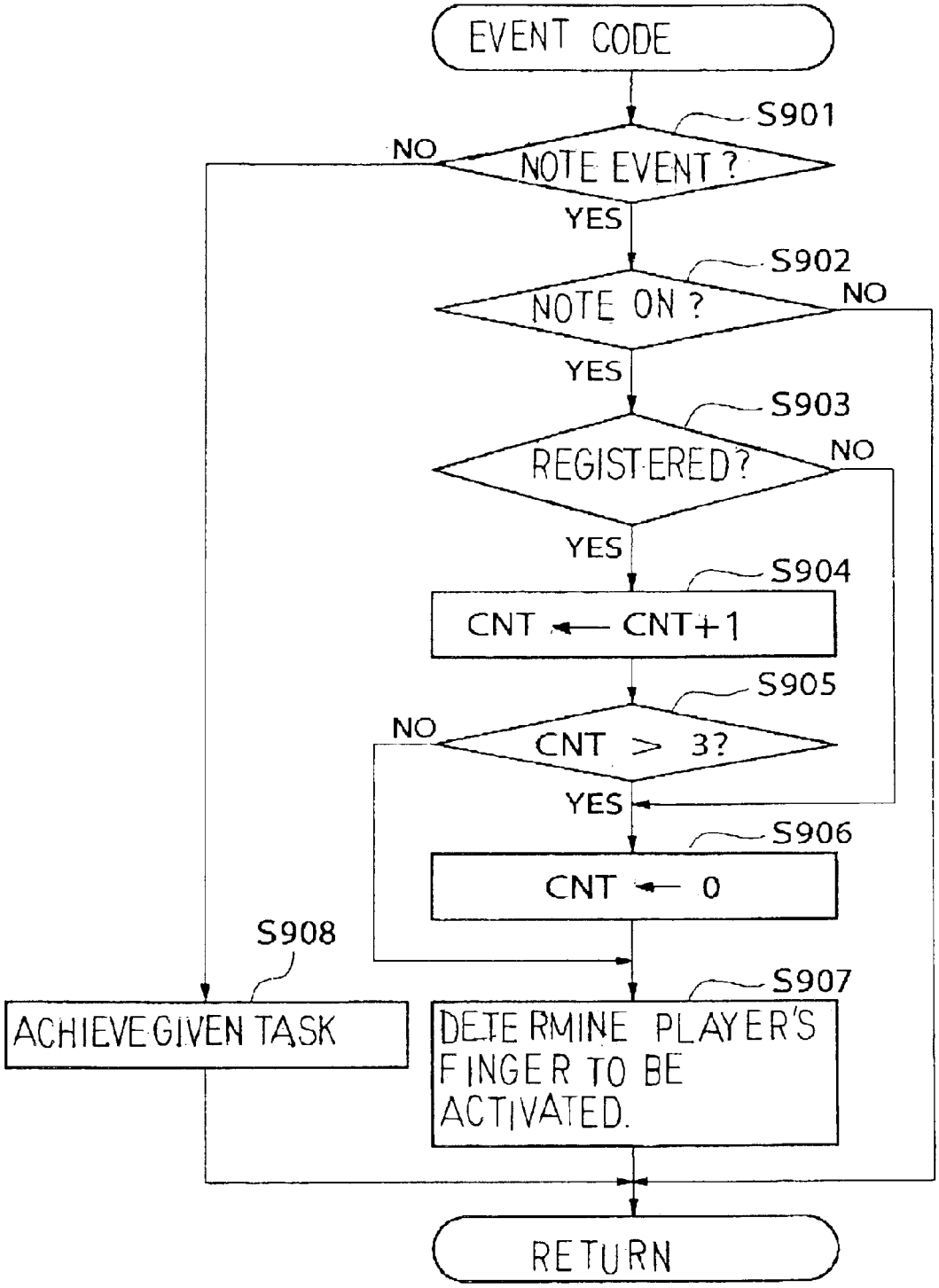
FIG. 21 is a flowchart showing a subroutine program executed for generating tones.

FIG. 21 shows the subroutine program for the data processing on an event code. Upon entry into the subroutine program, the central processing unit 11 checks the music data code to see whether event code represents a note event as by step S901. If the answer is given negative, the central processing unit 11 achieves the given task as by step S908, and, thereafter, returns to the main routine program.

On the other hand, when the event code represents the note event, the answer is given affirmative, and the central processing unit 11 checks the event code to see whether or not the note-on event is to be requested as by step S902. If the event code represents the note-off, the answer at step S902 is given negative, and the central processing unit 11 returns to the main routine program.

When the event code represents the note-on, the answer at step S902 is given affirmative, and the central processing unit 11 fetches the data codes representative of the note number and velocity (see FIG. 7). The central processing unit 11 specifies the reed group CNT(kn) assigned the tone kn to be generated.

Subsequently, the central processing unit 11 checks the key buffer to see whether or not the note number kn has been already registered in the key buffer as by step S903. If the note number kn has not been registered, yet, the automatic player is not expected to repeatedly generate the tone kn in twenty seconds, and the central processing unit 11 proceeds to step S906 without execution at steps S904/S905.

On the other hand, if the note number kn has been already registered in the key buffer, the answer at step S903 is given affirmative, and proceeds to step S904. The central processing unit 11 fetches the count CNT stored for the specified reed group CNT(kn) from the status table (see FIG. 9), and increments the count CNT by 1 as by step S904. Thus, the note number assigned to the tone to be generated is to be repeatedly generated in twenty seconds, the reed 32*b* to be driven for vibrations is changed from one to another in the associated reed group. For this reason, the vibrating reed is never plucked with the player's finger, and the reeds are prevented from the harsh tone.

Subsequently, the central processing unit 11 checks the value CNT to see whether or not the incremented value CNT is greater than 3 as by step S905. If the answer is given affirmative, the central processing unit 11 changes the value to zero as by step S906. Thus, the value CNT is circulated between zero to 3 for repeatedly generating the tone at short intervals. After step S906, the central processing unit proceeds to step S907. In case where the central processing unit 11 proceeds from step S903 to step S906, the tone is generated by the reed 32*b* of the tone generating stage STA. If the actuator table shown in FIG. 16 has been established in the random access memory 13, the tone is generated through the multi-reed tone generation.

When the value CNT is equal to or less than 3, the answer at step S905 is given negative, and the central processing unit 11 proceeds to step S907 without execution at step S906.

When the central processing unit 11 reaches step S907, the central processing unit 11 combines the note number kn with the count CNT. The central processing unit 11 accesses the actuator table in the read only memory (see FIG. 8 or FIG. 16), and reads out the code assigned a player's finger specified by the combination of note number (kn) and count value (CNT). Thus, the central processing unit 11 determines the player's finger SOL to be activated as by step S907, and requests the driver circuit 17 to supply the driving signal to the solenoid-operated actuator 21 incorporated in the player's finger SOL.

The driver circuit 17 supplies the driving signal to the solenoid-operated actuator 21 of the selected player's finger SOL. Then, the magnetic field is created in the solenoid-operated actuator 21. The pick 22 is inwardly inclined, and the plunger 26 upwardly projects from the bobbin 23. The pick 22 is brought into contact with the tip 32*c* of the reed 32*b* of the daisy reed wheel 32, and plucks the reed 32*b* for generating the tone kn.

When the elastic force exceeds the magnetic force, the pick 22 is outwardly inclined. The driver circuit 17 removes the magnetic force upon reaching the upper dead point, and the plunger 26 and pick 22 are moved toward the rest position. The spring 25 keeps the pick 22 outwardly inclined. For this reason, the pick 22 does not interfere with the vibrating reed 32*b*.

After the central processing unit 11 requests the driver circuit 17 to activate the selected player's finger, the central processing unit 11 returns to the subroutine program shown in FIG. 20.

As will be understood, the musical instrument implementing the fourth embodiment accumulates the music data codes to be processed within the predetermined time period, and checks the music data codes to see whether or not a note number or numbers are common to plural note events. The central processing unit 11 registers the note number or numbers common to plural note events. Thus, the central processing unit looks ahead in the near feature, and determines the tone or tones to be repeatedly generated. If the tone is to be repeatedly generated, the central processing unit 11 changes the tone generating stage from one to another at every tone generation. On the other hand, if the next tone generation is not scheduled in the event buffer, i.e., the predetermined time period, the automatic player produces the tone through the reeds 32*b* of the predetermined tone generating stage or stages. In case where the actuator table shown in FIG. 8 is used, the isolated tones are generated from the predetermined tone generating stage such as STA, and the tones are exactly produced on the scale. On the other hand, in case where the actuator table shown in FIG. 16 is used, the isolated tones are generated through the multi-reed tone generation, and the deep tones give an artificial representation to the users.

In the fourth musical instrument, the time counters are not required for the controller CL. The central processing unit 11 is not expected to increment the time counters TCNT(kn). This feature is desirable, because the central processing unit 11 consumes a non-ignoreable amount of time for incrementing all the time counters TCNT(kn) (see step S403 in FIG. 14). Even if the tone generating stages are increased, the controller 11 of the fourth embodiment can process the music data codes. If the actuator table shown in FIG. 16 is employed in the controller CL, the advantages of the third embodiment are also achieved by the fourth embodiment.

The followings are a summary of the description on the musical instruments according to the present invention. The tone generator includes the plural reed groups, and the automatic player selectively gives rise to vibrations in one or more than one of the reeds selected from each reed group for generating a tone. This means that the automatic player can prevent the vibrating reed or reeds from plucking. As a result, any harsh tone is never produced from the tone generator.

Another attractive point of the musical instrument according to the present invention is that the automatic player measures the lapse of time from the previous tone generation for each of the reed groups. When the lapse of time does not exceed the threshold value, the automatic player assumes that the previously plucked reed is still vibrating, and selects another reed from the reed group. This feature is desirable, because any sensors are not required for the reeds. This results in the simple musical instrument.

Still another attractive point of the musical instrument according to the present invention is that the automatic player can generates the tones through the multi-reed tone generations. Of course, the musical instrument may generate the tones selectively through the multi-reed tone generation and single tone generation. The multi-reed tone generation makes the tones deep, and impressed the audience with the deep tones.

The look-ahead technologies are also attractive. The music data codes are previously transferred to the event buffer, and a note number or numbers common to more than one note event is registered in the key buffer also previously. While the central processing unit is processing the music data codes, the key buffer is checked for the note numbers to be generated, and the central processing unit selects the reeds to be driven for vibrations from the plural tone generating stages. The additional load in the data processing is to periodically replace the music data codes in the event buffer with new music data codes and register the note number or numbers in the key buffer. The central processing unit is not expected to have an extremely high data processing speed. This means that a standard micro-processor is available for the musical instrument. As a result, the standard micro-processor makes the production cost reduced.

Relation Between Embodiments and Claims

The tone generating stages STA/STB/STC/STD serve as plural tone generating units, and the reeds are corresponding to vibratory members. A monitor, a selector, a report and a driver are correlated with the followings.

In the first embodiment, the monitor is corresponding to the central processing unit 11 and the programmed instructions for steps S303/304/305, and the report is corresponding to the status table shown in FIG. 9. The selector is implemented by the central processing unit 11, actuator table shown in figure 8 and programmed instructions for step S306. The central processing unit 11, programmed instructions for steps 201–209 and driver circuit 17 serves as the driver.

In the second embodiment, a time keeper is corresponding to the central processing unit 11, time counters TCNT(kn) and programmed instructions for steps S403/S503/S508. The monitor, selector and driver are same as those of the first embodiment.

In the third embodiment, the selector includes the actuator table shown in FIG. 16 instead of the actuator table shown in FIG. 8. The timer keeper serves as a forecaster in the third embodiment.

In the fourth embodiment, the monitor is corresponding to the central processing unit 11, event buffer and programmed instructions for steps 703/704/705/707/708/709/710/711, and the key buffer serves as the report. The selector is corresponding to the central processing unit 11 and programmed instructions for steps S903/904/905/906/907, and the driver is corresponding to the driver circuit 17, central processing unit 11 and programmed instructions for steps 801 t0 808.

Although particular embodiments of the present invention have been shown and described, it will be apparent to those skilled in the art that various changes and modifications may be made without departing from the spirit and scope of the present invention.

In the first to fourth embodiments, the daisy reed wheels are used in the tone generators. However, comb-like reed arrays may be employed in the modifications of the embodiments according to the present invention. Moreover, the reeds may be replaced with strings or tone bars. In case where the strings are used in the tone generator like a harp, the player's fingers are disposed at certain positions beside the respective strings, and turn at 90 degrees with respect to the positions in the first to fourth embodiments. When the strings are plucked at certain points dividing the length of the associated strings at 1:7, the strings naturally vibrate, and generate clear tones. In case where the tone bars are employed in a tone generator, the player's fingers selectively beat the tone bars for generating the tones.

In the third embodiment and fourth embodiment employing the actuator table same as that of the third embodiment, the reeds of the tone generating stage STA may be slightly different in pitch from the reeds of the tone generating stage STC. In this instance, tones become deeper.

Another musical instrument according to the present invention, tones may be always generated through the multi-reed tone generation. For example, when the count CNT takes the value 1 or 3, the actuator table correlates the combinations of note numbers kn and the count value 1/3 with both tone generations stages STB and STD. Even if the tones are repeated at short intervals, the tone generating stages STA/STC and tone generating stages STB/STD are alternately used for the tone, and the vibrating reeds are never plucked with the player's fingers.

Yet another musical instrument according to the present invention may include more than four tone generating stages, and more than two tone generating stages may be concurrently actuated by the automatic player for the multi-reed tone generation. The tones generated through the multi-reed tone generation become much deeper. However, it is recommendable to concurrently actuate every other tone generating stage, because the vibrating reeds never interfere with one another.

Still another musical instrument according to the present invention may have more than one actuator table. In this instance, the user may select one of the actuator tables before the automatic playing. Otherwise, only a default actuator table may be stored in the read only memory. In this instance, other actuator tables are stored in the external memory. When the user wishes to use another actuator table, the actuator table is transferred from the external memory to the random access memory 13, and the central processing unit 11 looks for the player's finger or fingers in the actuator table in the random access memory 13 instead of the default actuator table in the read only memory 12. The following actuator tables may be employed in the musical instrument.

An actuator table may correlates the combinations of note numbers kn and the count value 0, 1 and 2 with the player's fingers. When the count value CNT is 0, the actuator table correlates the combinations with two tone generating stages STA and STC. When the count value CNT is 1 or 2, the actuator table STB or STD is activated. The tones are usually generated through the multi-reed tone generation, and the vibrating reed is never plucked in the repetition at short intervals.

Another actuator table may correlate the combinations of note numbers kn and counter values 0, 1, 2, 3 and 4 with the tone generating stage or stages (STA+STC+STB+STD), STA, STB, STC and STD, respectively. In this instance, the user may have an option between the single reed tone generation and the multi-reed tone generation. When the user requests the automatic player to perform a piece of music where the repetition at short intervals is rare, the controller CL fixes the count value CNT to zero, and deep tones are produced through the multi-reed tone generation. On the other hand, if the repetition at short intervals is expected, the count value CNT is looped between 1 and 4 for producing the tones through the single reed tone generation. The user may take the option through a switch on the manipulating panel 19. Otherwise, the user inserts an exclusive message representative of the option in the set of music data codes. The exclusive message is added to the set of music data codes in the form of event code. The event code is, by way of example, processed at step S307. In a modification of the third embodiment, the threshold for the timer counters TCNT(kn) may be changed between a standard value such as 500 and an extremely large value. The change of the threshold is equivalent to a change of the actuator table.

Thus, the modifications of the musical instruments change the mode of tone generation depending upon the passage to be performed. For this reason, although the automatic player generates the acoustic tones through the mechanical vibrations of vibratory members.

The music data codes may be supplied through the MIDI interface from a musical instrument, and the automatic player produces the tones in a real time fashion.

The musical instrument, i.e., the combination of tone generator and automatic player according to the present invention may form parts of a toy or electrical goods.

The player's fingers may have another sort of actuators such as, for example, a pneumatic actuators or hydraulic actuators.

What is claimed is:

1. A musical instrument for generating acoustic tones, comprising:

a tone generator including plural tone generating units each having plural vibratory members for generating said acoustic tones through vibrations, the vibratory members of said plural tone generating units forming plural vibratory groups respectively assigned to said acoustic tones;

an automatic player including plural sets of player's fingers respectively associated with said plural tone generating units and selectively actuated so as to give rise to said vibrations in the associated vibratory members and a controller connected to the player's fingers and selectively actuating said player's fingers on the basis of pieces of music data for generating the tones along a passage, said controller having a monitor producing a report indicative of the vibratory members already driven for vibrations for generating tones along said passage, a selector checking said report for said vibratory members already driven for said vibrations and selecting other vibratory members from the vibratory groups respectively containing said vibratory members already driven for said vibrations so as to prevent said vibratory members already driven for said vibrations from being continuously driven for the vibrations before a decay of said vibrations and a driver selectively actuating the player's finger associated with said other vibratory members and the vibratory members not driven for vibrations for generating said tones along said passage.

2. The musical instrument as set forth in claim 1, in which said vibratory members are implemented by reeds.

3. The musical instrument as set forth in claim 2, in which said reeds radially projecting from a hub for forming a daisy reed wheel serving as each of said tone generating unit.

4. The musical instrument as set forth in claim 3, further comprising a resonator, in which the plural daisy reed wheels serving as said plural tone generating units are connected to said resonator so that said tones are increased in loudness.

5. The musical instrument as set forth in claim 4, further comprising a post, in which said post is upright on said resonator, and said plural daisy wheels are supported by said post at intervals.

6. The musical instrument as set forth in claim 4, further comprising a bell, in which said tones are radiated from said resonator through said bell to the outside.

7. The musical instrument as set forth in claim 1, in which said selector automatically changes vibratory members to be driven for vibrations from said vibratory members already driven for said vibrations to said other vibratory members.

8. The musical instrument as set forth in claim 7, in which said report correlates said vibratory groups with said vibratory members already driven for said vibrations, and said selector selects said other vibratory members from said vibratory groups when said selector finds said vibratory members already driven for said vibrations in said report.

9. The musical instrument as set forth in claim 1, in which said controller further has a time keeper measuring a lapse of time from a previous tone generation for each of said vibratory group, and said selector changes vibratory members to be driven for vibrations from said vibratory members already driven for said vibrations to said other vibratory members if values of said lapse of time exceed a threshold value.

10. The musical instrument as set forth in claim 9, in which said vibrations are presumed to be decayed within said threshold value.

11. The musical instrument as set forth in claim 9, in which said time keeper has a table correlating said vibratory groups with said lapse of time and periodically varied with time, and said selector checks said table to see whether or not the values of said lapse of time exceeds said threshold value before selecting the other vibratory members from the vibratory groups associated with the tones to be generated.

12. The musical instrument as set forth in claim 1, further comprising a forecaster forecasting whether or not the reeds have already decayed said vibrations and producing another report indicative of vibratory members presumed to be still vibrating and vibratory members presumed to be non-vibrating, and said selector selects more than one vibratory member from the vibratory group associated with each tone to be generated when said selector finds associated one of said vibratory members already driven for said vibrations to be registered in said another report as one of said vibratory members presumed to be non-vibrating.

13. The musical instrument as set forth in claim 12, in which said forecaster measures a lapse of time from a previous tone generation for each of said vibratory group, and decides a vibratory member already driven for the vibrations to be still vibrating if the value of said lapse of time is less than a threshold value and another vibratory member already driven for the vibrations to be non-vibrating if the value of said lapse of time is equal to or greater than said threshold.

14. The musical instrument as set forth in claim 12, in which said selector selects one of the vibrator members from each vibratory group associated with one of said tones to be generated when said selector finds associated one of said vibratory members already driven for said vibrations to be registered in said another report as one of said vibratory members presumed to be still vibrating.

15. The musical instrument as set forth in claim 12, in which said selector selects another combination of vibratory members different from said more than one vibratory member when said selector finds associated one of said vibratory members already driven for said vibrations to be registered in said another report as one of said vibratory members presumed to be non-vibrating.

16. The musical instrument as set forth in claim 1, in which said monitor looks ahead a predetermined time period so as to determine the tones to be produced more than once within said predetermined time period, and presumes the vibratory members of the vibratory groups associated with said tones to be generated more than once to be said vibratory members already driven for said vibrations.

17. The musical instrument as set forth in claim 16, in which said selector selects more than one vibratory member from each vibratory group associated with one of said tones to be generated when said selector does not find any one of said vibratory members of said each group to be one of said vibratory members already drive for said vibrations.

18. The musical instrument as set forth in claim 16, in which said selector selects one of the vibrator members from each vibratory group associated with one of said tones to be generated when said selector does not find any one of said vibratory members of said each vibratory group to be one of said vibratory members already driven for said vibrations.

19. The musical instrument as set forth in claim 17, in which said selector selects another combination of vibratory members different from said more than one vibratory member from each vibratory group associated with one of said tone to be generated when said selector finds said more than one vibratory members to be the vibratory members already driven for said vibrations.

20. The musical instrument as set forth in claim 1, in which said tone generator and said automatic player form parts of a music box.

* * * * *